US010548401B2

(12) United States Patent
Sewell et al.

(10) Patent No.: US 10,548,401 B2
(45) Date of Patent: Feb. 4, 2020

(54) SEATING FURNITURE

(71) Applicant: Campaign Inc., Emeryville, CA (US)

(72) Inventors: Bradley Sewell, Emeryville, CA (US); Raul Molina, Emeryville, CA (US); Katherine Gossett, Oakland, CA (US)

(73) Assignee: Campaign, Inc., Emeryville, CA (US)

( * ) Notice: Subject to any disclaimer, the term of this patent is extended or adjusted under 35 U.S.C. 154(b) by 0 days.

(21) Appl. No.: 15/685,260

(22) Filed: Aug. 24, 2017

(65) Prior Publication Data

US 2017/0347799 A1 Dec. 7, 2017

Related U.S. Application Data

(63) Continuation-in-part of application No. 15/247,092, filed on Aug. 25, 2016.

(60) Provisional application No. 62/209,648, filed on Aug. 25, 2015, provisional application No. 62/378,874, filed on Aug. 24, 2016.

(51) Int. Cl.

| | |
|---|---|
| ***A47C 4/02*** | (2006.01) |
| ***A47C 31/02*** | (2006.01) |
| ***A47B 95/00*** | (2006.01) |

(52) U.S. Cl.

CPC ..... *A47C 4/028* (2013.01); *A47B 95/00* (2013.01); *A47C 31/02* (2013.01)

(58) Field of Classification Search

CPC ..... A47C 4/02; A47C 31/02; A47C 4/028; A47B 95/00

USPC ... 297/440.24, 452.18, 440.14, 450.1, 440.1, 297/440.2, 452.2

See application file for complete search history.

(56) References Cited

U.S. PATENT DOCUMENTS

| | | | | |
|---|---|---|---|---|
| 1,392,242 | A | 9/1921 | Albergoli | |
| 3,030,146 | A * | 4/1962 | Faxon | A47C 4/02 297/411.45 |
| 3,058,777 | A | 10/1962 | Froedge | |
| 3,104,913 | A | 9/1963 | Faulkner | |
| 3,887,234 | A | 6/1975 | Curtis | |
| 4,043,591 | A | 8/1977 | Lehmann | |
| 4,435,103 | A | 3/1984 | Becker | |
| 5,306,072 | A | 4/1994 | Caldwell | |
| 5,529,380 | A * | 6/1996 | Blansett | A47C 4/02 297/440.23 |
| 5,649,742 | A | 7/1997 | Liu | |
| 5,678,897 | A * | 10/1997 | Prestia | A47C 4/02 297/440.15 |
| 5,988,755 | A | 11/1999 | Fastelli | |
| 6,669,401 | B1 | 12/2003 | Lin | |
| 6,783,182 | B1 * | 8/2004 | Gallagher | A47C 4/02 297/440.14 |

(Continued)

FOREIGN PATENT DOCUMENTS

| | | | | |
|---|---|---|---|---|
| EP | 0595310 A1 * | 5/1994 | | A47C 4/02 |

*Primary Examiner* — Milton Nelson, Jr.
(74) *Attorney, Agent, or Firm* — Bejin Bieneman PLC

(57) ABSTRACT

A kit for assembling a piece of seating furniture includes a back assembly including a rear beam having a pair of opposing distal ends designed to be received by a pair of side assemblies. The back assembly includes a plurality of support beams defining a passage. The kit includes a front assembly including a front beam having a pair of opposing distal ends designed to be received by the pair of side assemblies. The front assembly is disposed within the passage.

20 Claims, 23 Drawing Sheets

(56) References Cited

U.S. PATENT DOCUMENTS

| | | | | |
|---|---|---|---|---|
| 7,438,361 | B1 * | 10/2008 | Huang | A47C 7/282<br>297/452.18 |
| 8,356,954 | B2 * | 1/2013 | Koch | F16B 21/09<br>403/353 |
| 2004/0140706 | A1 * | 7/2004 | Harrison | A47C 4/02<br>297/440.23 |
| 2015/0305504 | A1 * | 10/2015 | Robinson | A47C 7/16<br>297/452.18 |

* cited by examiner 10
20
30
39
51
52
53
60
61
62
65
70
71
72
80
81
82
82s
82t
83
83b
83t
86
89
100
101
101b
101h
101t
102
103
103b
103s
103t
104
104s
104t
120
22
26
27
27h
29
35f
35r

SEATING FURNITURE

CROSS-REFERENCE TO RELATED APPLICATIONS

The subject patent application is a continuation-in-part of, and claiming priority to and all the benefits of, U.S. patent application Ser. No. 15/247,092 filed on Aug. 25, 2016, which claimed priority and all the benefits of U.S. Provisional Patent Application No. 62/209,648 filed on Aug. 25, 2015, and U.S. Provisional Patent Application No. 62/378,874 filed on Aug. 24, 2016, all of which are herein incorporated by reference in their entirety. The subject patent application also claims priority to and all the benefits of U.S. Provisional Patent Application No. 62/378,874 filed on Aug. 24, 2016, which is herein incorporated by reference in its entirety.

BACKGROUND

Various seating furniture structures such as chairs, love seats and couches are generally known. Traditionally, this furniture is either preassembled or requires assembly by a user. Preassembled furniture can be bulky and expensive to ship and move from location to location. Furniture requiring assembly typically is not as robust, may be difficult and time consuming to assemble, and may not easily disassemble and reassemble for easy moving. Accordingly, seating furniture that is easy to assembly, and is robust, is desired.

DETAILED DESCRIPTION

Figure 1:
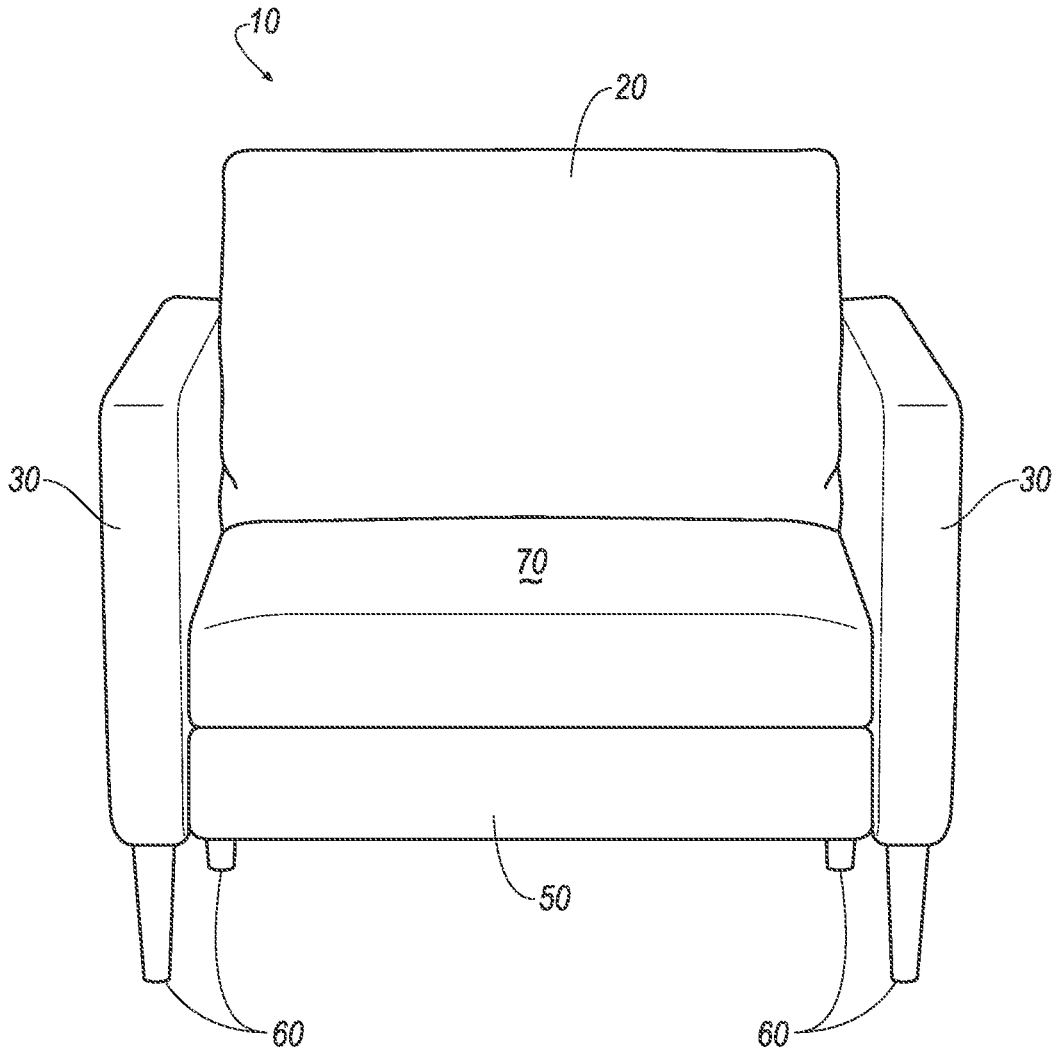
FIG. 1 is a perspective view of an example piece of seating furniture.
Figure 2:
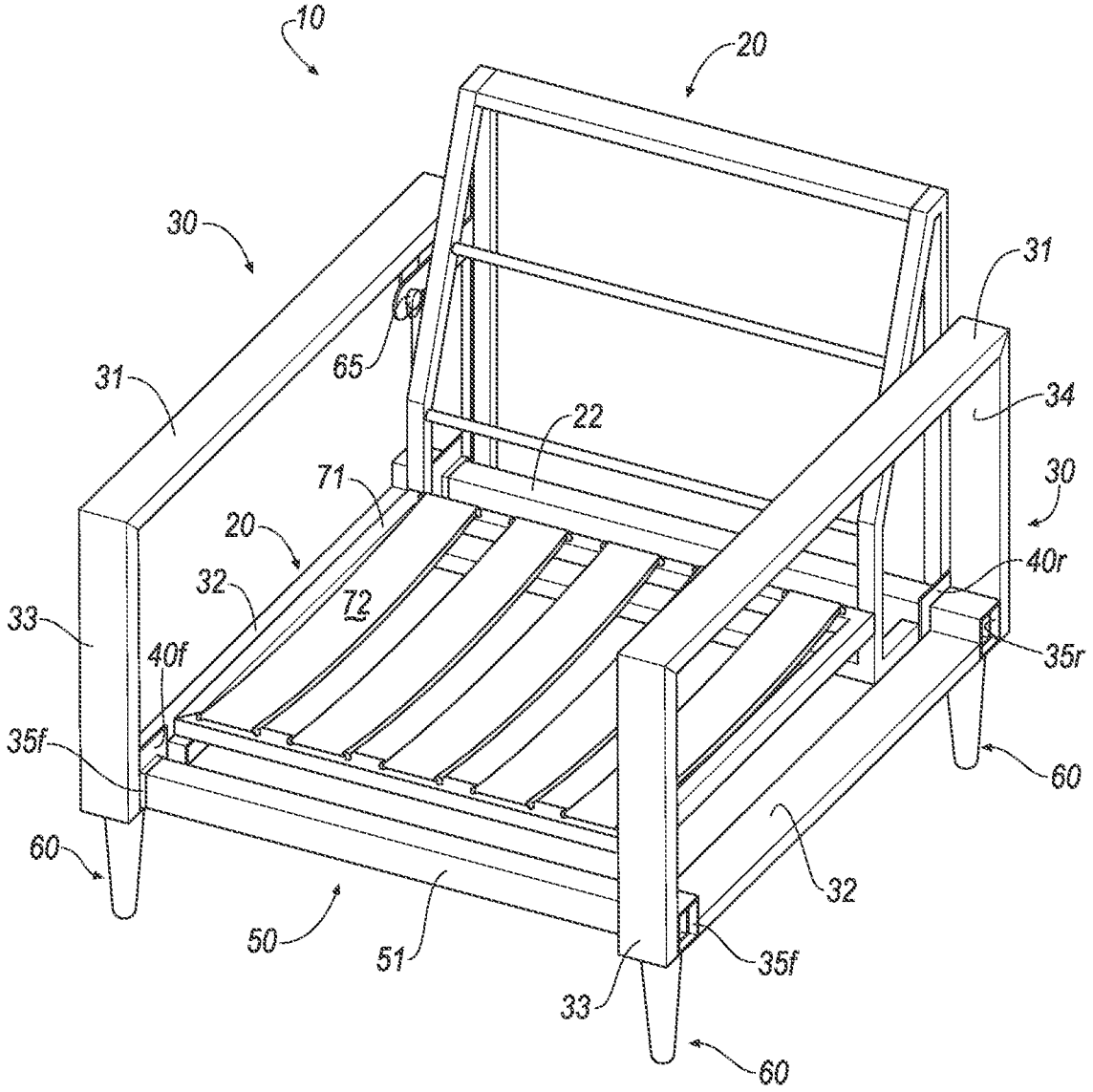
FIG. 2 is a perspective view of a frame of the example piece of seating furniture of FIG. 1.
Figure 3:
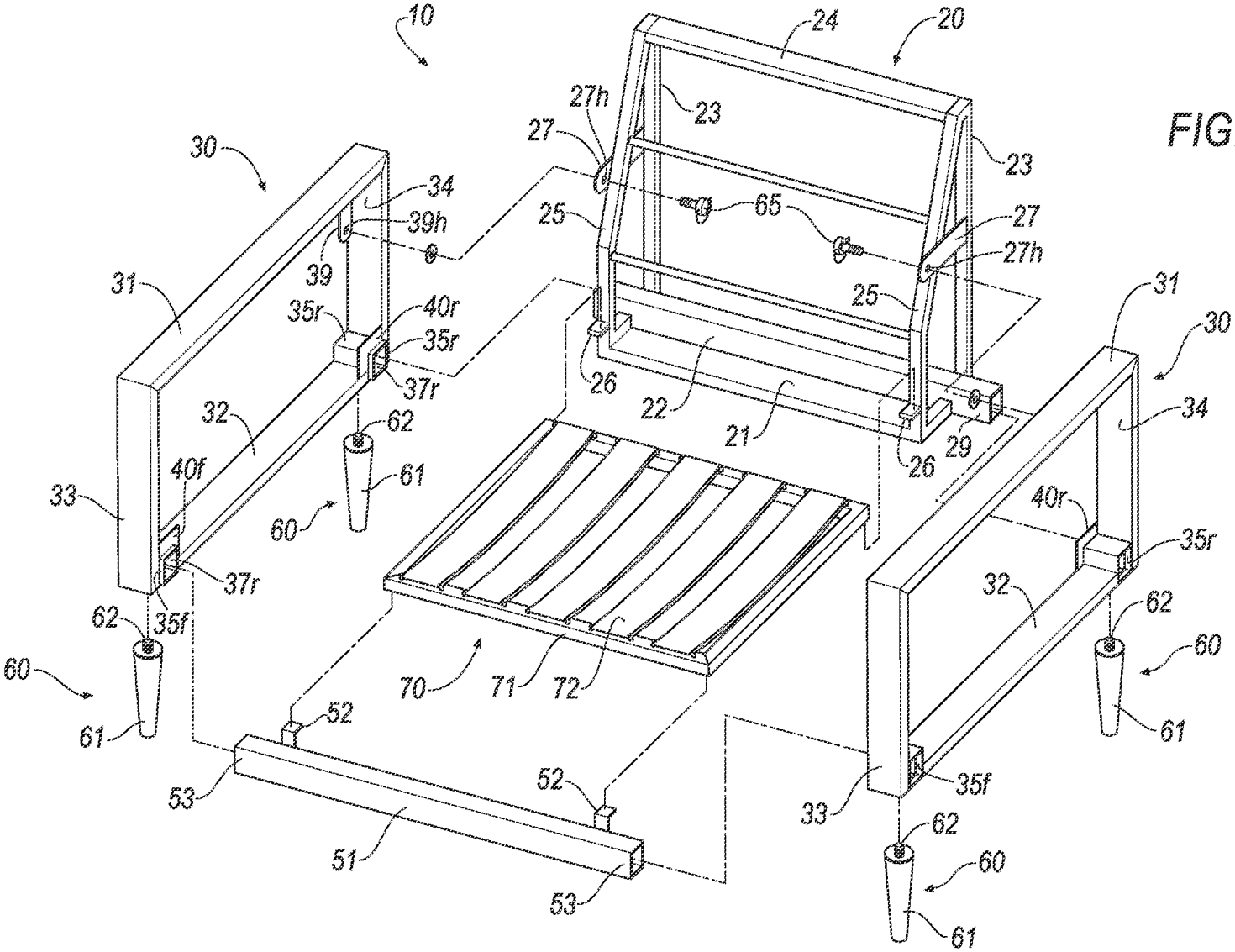
FIG. 3 is an exploded perspective view of assemblies forming the frame of the example piece of seating furniture of FIG. 1.
Figure 4:
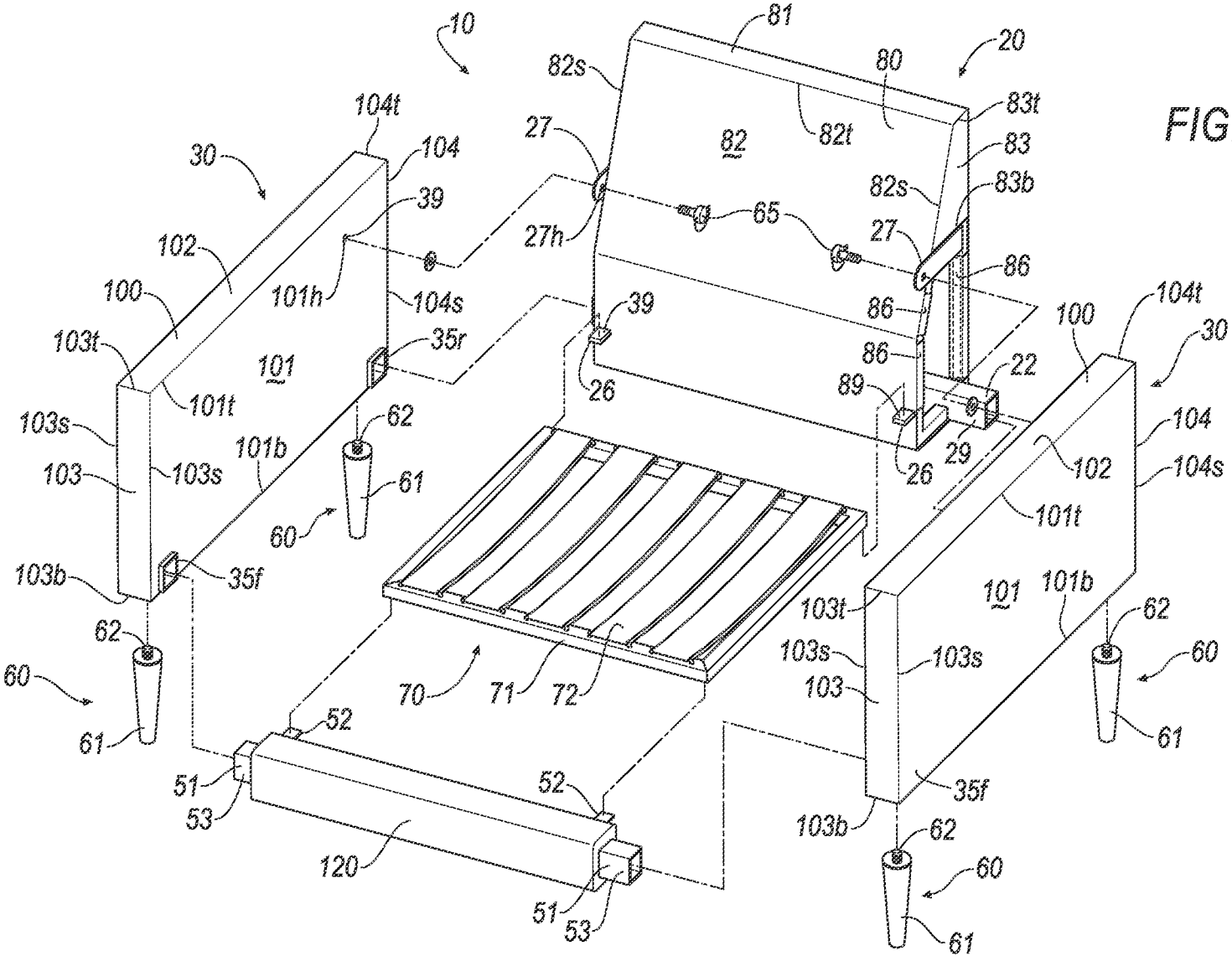
FIG. 4 is an exploded perspective view of assemblies in a kit for the example piece of seating furniture of FIG. 1.
Figure 5:
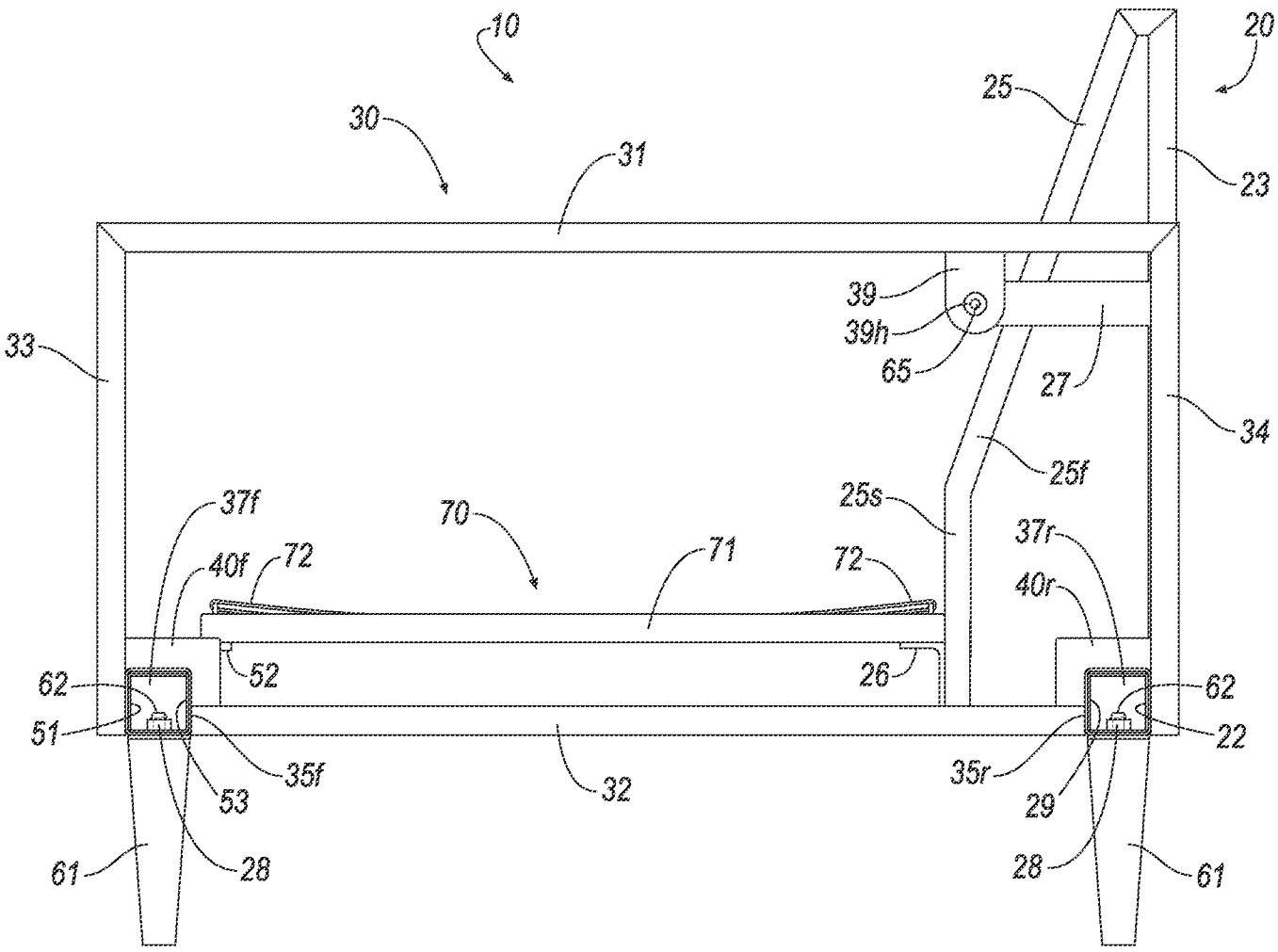
FIG. 5 is a side view of the frame of the example piece of seating furniture of FIG. 1.

A kit for assembling a piece of seating furniture includes a back assembly including a rear beam having a pair of opposing distal ends designed to be received by a pair side assemblies, the back assembly including a plurality of support beams defining a passage. The kit includes a front assembly including a front beam having a pair of opposing distal ends designed to be received by the pair of side assemblies. The front assembly is disposed within the passage.

The front assembly may include a covering disposed around the front beam and within the passage.

The front assembly may include a cushion, the covering may be disposed around the cushion.

The covering may include a slit, and the front assembly may include a frame support secured to the front beam and disposed within the slit.

The back assembly may include a covering.

The covering of the back assembly may define an opening, and the front assembly may be accessible via the opening.

The covering may include a slit, and the back assembly may include a frame support secured to one of the support beams and disposed within the slit.

The covering may include a front panel having top edge and a bottom edge defining a distance therebetween, and a side panel having a top edge and a bottom edge defining a distance therebetween that is less than the distance between the top edge and the bottom edge of the front panel.

The covering may include a back panel having top edge and a bottom edge defining a distance therebetween, and a side panel having a top edge and a bottom edge defining a distance therebetween that is less than the distance between the top edge and the bottom edge of the back panel.

The covering may include a back panel and a front panel collectively defining a cavity, the support beams disposed within the cavity.

The back assembly may include a base plate further defining the passage.

The kit may include the pair of side assemblies.

Each side assembly may include a member receiving structure designed to receive one of the distal end of the back assembly and the distal end of the front assembly.

Each side assembly may include a core.

The cores may be made of expanded polypropylene.

The cores may each define a recessed channel, and the side assemblies may each include a side plate disposed within one of the recessed channels.

Each of the side plates may include a hole, and each of the side assemblies may include a covering having a hole that aligns with the hole of the one of the side plates.

Each of the cores may include a notch, and each of the member receiving structure are disposed within one of the notches.

Each side assembly may include a covering having a pair of opposing side panels and a pair of flaps extending from opposing side panels, the flaps releasably securable to each other.

One of the side panels may include a pair of notches, and one of the flaps may be disposed between the notches.

With reference to the Figures, a kit for assembling a piece of seating furniture 10 includes a back assembly 20 including a rear beam 22 having a pair of opposing distal ends 29 designed to be received by a pair side assemblies 30. The back assembly 20 includes a plurality of support beams 23, 25 defining a passage 20*p*. The kit includes a front assembly 50 including a front beam 33 having a pair of opposing distal ends 53 designed to be received by the pair of side assemblies 30. The front assembly 50 is disposed within the passage 20*p*.

Disposing the front assembly 50 within the passage 20*p* of the back assembly 20 helps to reduce the packaging size of the kit, e.g., such that the kit may be shipped to a user in a smaller package, or in few packages, as comparted to when the front assembly 50 is separate from the back assembly 20.

The relative directions such as front, rear, back, side, bottom, and top are based on the perspective of a user sitting in the seating furniture 10 in an assembled state in a traditional manner.

The seating furniture 10 of the present disclosure includes the back assembly 20, the side assemblies 30, the front assembly 50, legs 60, D-ring screws 65, and a seating assembly 70.

The seating furniture 10 may be in an assembled state, as shown in FIGS. 1, 2, and 5-9, or in a disassembled state, as shown in FIGS. 3, 4, and 10-24. The seating furniture 10 may be provided to a user as the kit in the disassembly state, e.g., the user may assemble the kit to place the seating furniture 10 in the assembled state. In the disassembled state, e.g., in the kit, the front assembly 50 may be disposed within the back assembly 20. In the assembled state, the back assembly 20, side assemblies 30, front assembly 50, and seating assembly 70 may be secured together using on the legs 60 and D-ring screws 65.

With reference to FIGS. 1-5, 7, 8, 10, 13, 14, and 24, the back assembly 20 may include a base plate 21, the rear beam 22, a first pair of support beams 23, a top beam 24, a second pair of support beams 25, one or more suspension frame supports 26 and a pair of side plates 27.

The base plate 21 may be planar in form with a generally rectangular shape. The base plate 21 has a top surface, a bottom surface, a front edge, a rear edge, and side edges.

The rear beam 22 may be an elongated single piece member with a hollow square cross section. Alternately, the rear beam may be a multi-piece rear member, e.g., with a distal end of each piece extending from opposing sides of the rear assembly and the multiple pieces of the rear beam connected by additional rear assembly frame components (not shown).

The rear beam 22 may be secured to the top surface of the base plate 21, and extend parallel to the rear edge of the base plate 21. The opposing distal ends 29 of the rear beam 22 extend beyond the side edges of the base plate 21. A hole 22*h* may be defined in the rear beam 22 proximate each distal end 29. An interior surface of the hole 22*h* may be threaded. The rear beam 22 may include a reinforcement portion 28. The reinforcement portion 28 may further define the hole 22*h*. For example, the reinforcement portion 28 may be a weld nut secured to an interior of the rear beam 22 such that an axis of the nut aligns with an axis of the hole 22*h*.

The distal ends 29 of the rear beam 22 may secure the side assembly 30 to the back assembly 20. The distal ends 29 of the rear beam 22 are designed to be received by the pair of side assemblies 30, e.g., each of the distal ends 29 of the rear beam 22 may be sized to fit within a rear beam receiving structure 35*r* of one of the pair of side assemblies 30.

The first pair of support beams 23 may be elongated members that extend generally normal from the base plate 21 at various locations along the rear edge. The support beams 23 are secured to the base plate 21 and the rear beam 22, e.g., via welding. The support beams 23 are further supported by a crossbar member extending there between. It is understood and appreciated that more than two support beams 23 can be used based on various design criteria such as material properties, and seating furniture design. For example, additional support beams 23 can be used for various width designs such as chairs, love seats, and couches. For example, compare the frames assemblies shown in FIGS. 2 and 10. A top support beam 24 runs generally parallel to the rear beam 22, and is secured to the support beams 23, e.g., via welding. The top support beam 24 may be a single piece or multi-piece design.

The second pair of support beams 25 are secured at various locations along the front edge of the base plate 21 and extend perpendicular to the top beam 24, to which they are secured. The support beams 25 may include first and second linear portions 25*f*, 25*s*, jointed at an obtuse angle. Similar to the support beams 23; additional support beams 25 can be used depending on material and design selection.

The back assembly 20 may define a passage 20*p*. For example, the passage 20*p* may be between the support beams 23, 25 and elongated between the distal ends 29. The passage 20*p* may be further defined by the base plate 21.

The frame supports 26 may have an elongated L-shape with a pair of planar square surfaces joining at a generally perpendicular angle. One of the surfaces of each frame support 26 may be secured to one of the support beams 25. The other surface of each frame support 26 may extend away from the support beams 25, being generally parallel to the base plate 21 and perpendicular to the second linear portions 25*s* of the support beam 25.

The pair of side plates 27 may be planar in form and have a generally rectangular shape with a rounded half circle end. Each side plate 27 may be secured to one of the support beams 23 and to one of the support beams 25 such that the side plate 27 extends from the support beam 23 across the support beam 25 with the rounded half circle end extending beyond the support beam 25. A hole 27*h* may be located in each side plate 27 at the rounded half circle end. The side plates 27 are aligned generally perpendicular to the base plate 21.

The back assembly 20 may include a covering 80. The covering 80, shown in FIGS. 4, 11-14, and 23-24, may include a top panel 81, a front panel 82, pair of side panels 83 and a back panel 84. The panels 81, 82, 83, 84 may collectively define a cavity 85 therebetween.

The panels 81, 82, 83, 84 may be formed of leather, fabric, or and other suitable material. The panels 81, 82, 83, 84 may include a foam layer secured to the leather, fabric, etc., e.g., via stitching, adhesive etc. Two or more of the panels 81, 82, 83, 84 may be integral, i.e., a single piece of material with no seams, joints, fasteners, or adhesives holding it together. As example, two or more of the panels 81, 82, 83, 84 may be formed from a same piece of fabric, leather, etc. Two or more of the panels 81, 82, 83, 84 may be independently formed and joined, e.g. via stitching.

The front panel 82 may have a top edge 82*t*. The front panel 82 may be secured to the top panel 81 at the top edge 82*t*, e.g., via stitching, etc. Alternately, the top edge 82*t* may be where the front panel 82 transitions to the top panel 81, e.g., when the front panel 82 and the top panel 81 are integral.

Figure 11:
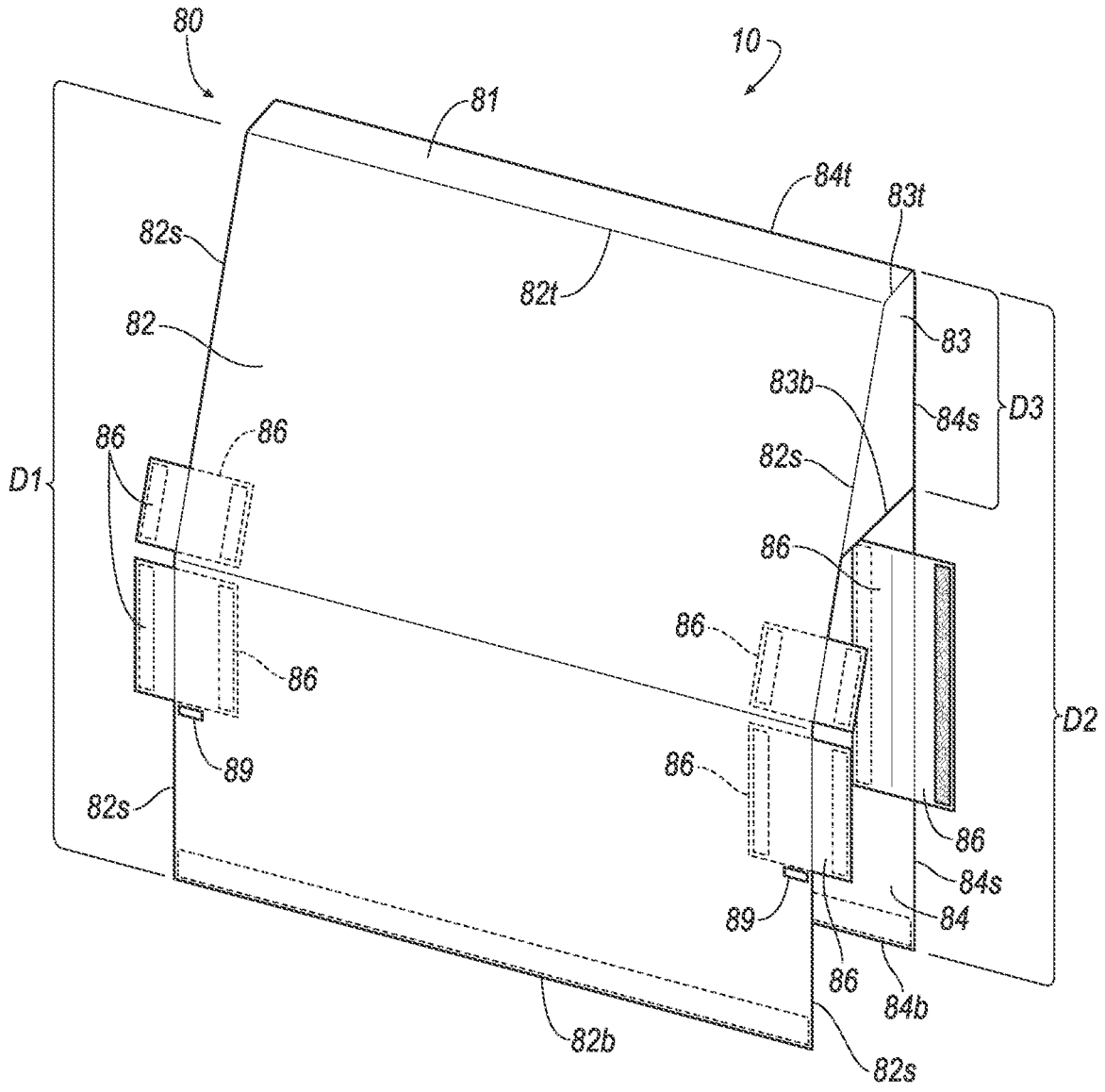
FIG. 11 is a front perspective view of an example covering of an example back assembly of the example piece of seating furniture of FIG. 1.
Figure 12:
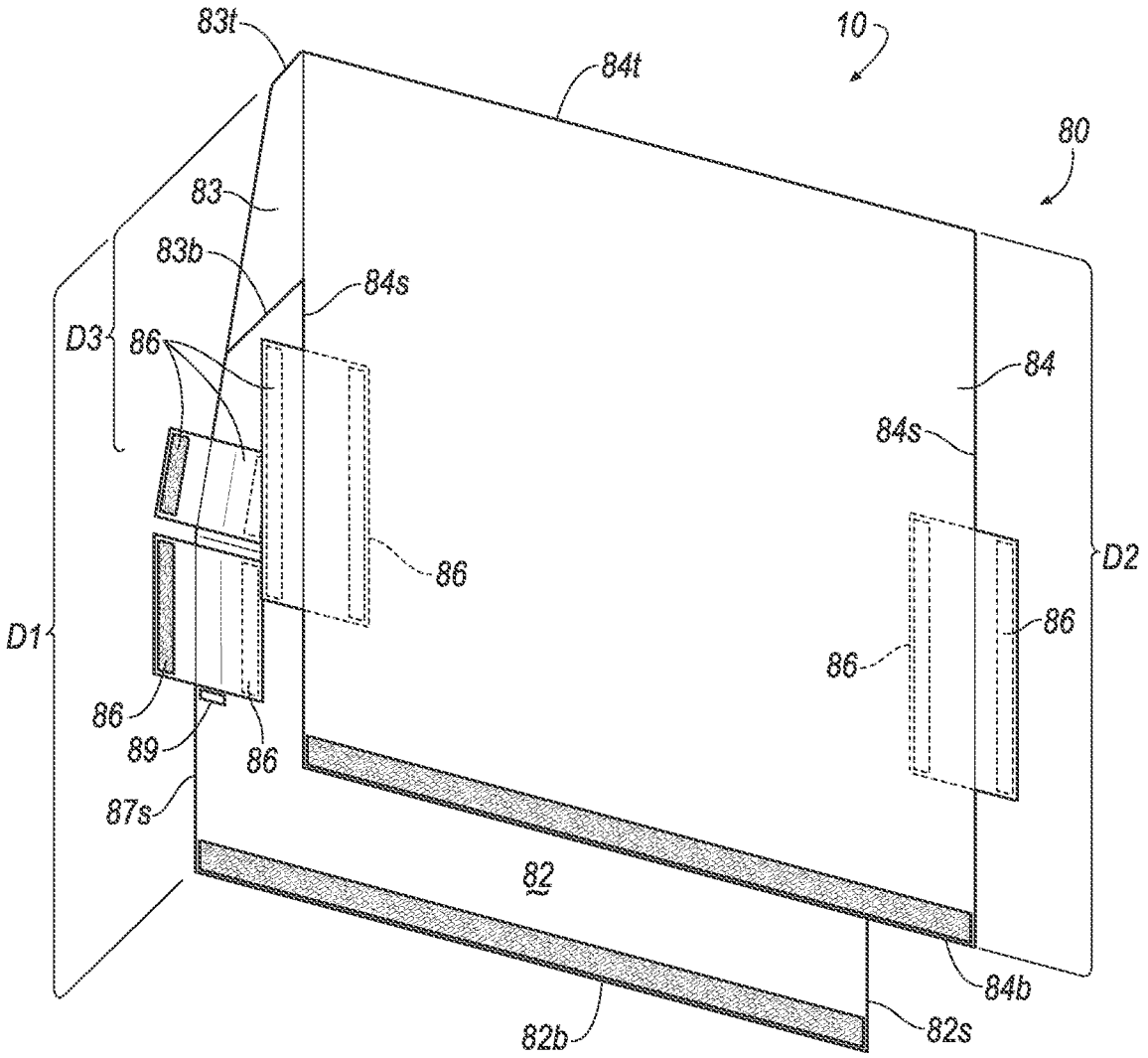
FIG. 12 is a rear perspective view of the example covering of FIG. 11.
Figure 13:
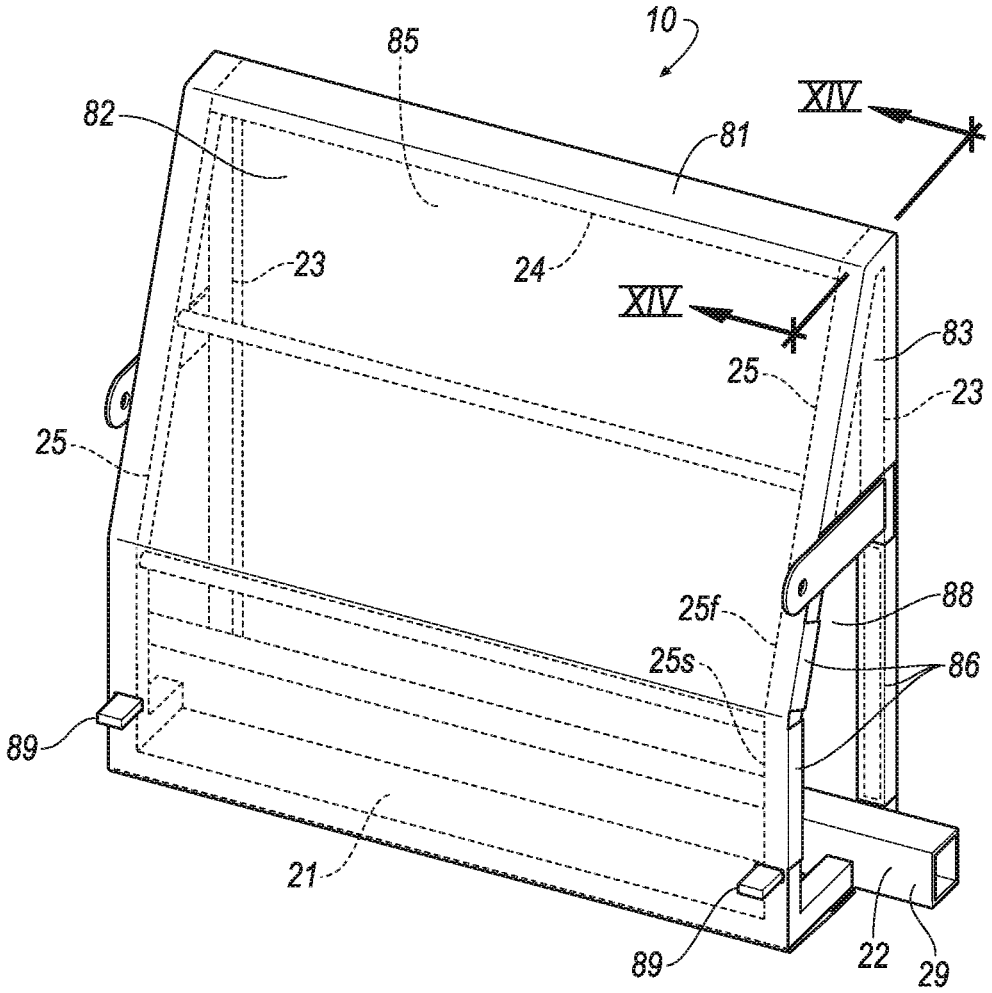
FIG. 13 is a front perspective view of the example back assembly of the example piece of seating furniture of FIG. 1.

The front panel 82 may include a bottom edge 82*b* opposite the top edge 82*t*. The top edge 82*t* may be spaced from the bottom edge 82*b* by a distance D1, as shown in FIGS. 11 and 12.

The front panel 82 may have a pair of opposing side edges 82*s*. The side edges 82*s* may be secured to the side panels 83, e.g., via stitching, etc. Alternately, the side edges 82*s* may be where the front panel 82 transitions to the side panels 83, e.g., when the front panel 82 and the side panels 83 are integral.

The back panel 84 may have a top edge 84*t*. The back panel 84 may be secured to the top panel 81 at the top edge 84*t*, e.g., via stitching, etc. Alternately, the top edge 84*t* may be where the back panel 84 transitions to the top panel 81, e.g., when the back panel 84 and the top panel 81 are integral.

The back panel 84 may include a bottom edge 84*b* opposite the top edge 84*t*. The top edge 824 may be spaced from the bottom edge 84*b* by a distance D2, as shown in FIGS. 11 and 12.

Figure 14:
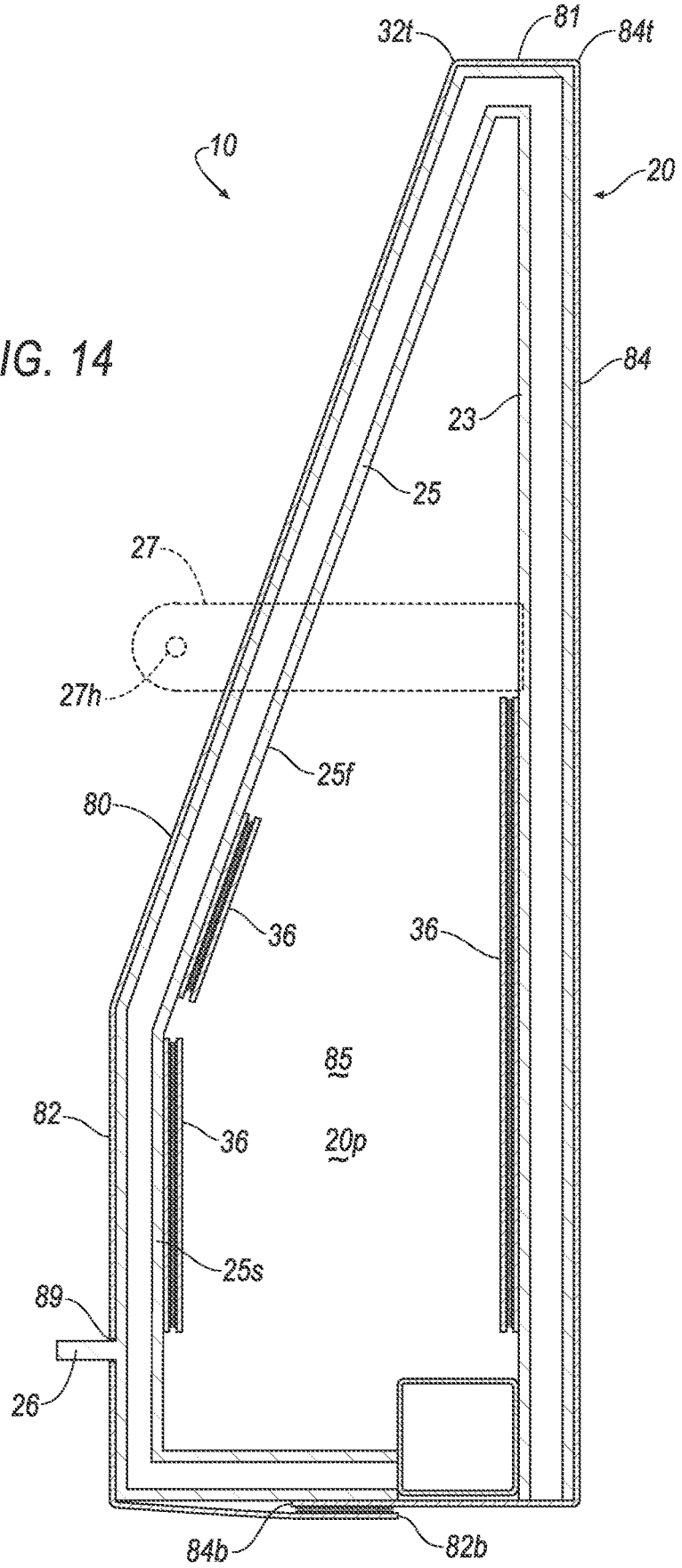
FIG. 14 is a cross section view of the example back assembly of FIG. 13.
Figure 24:
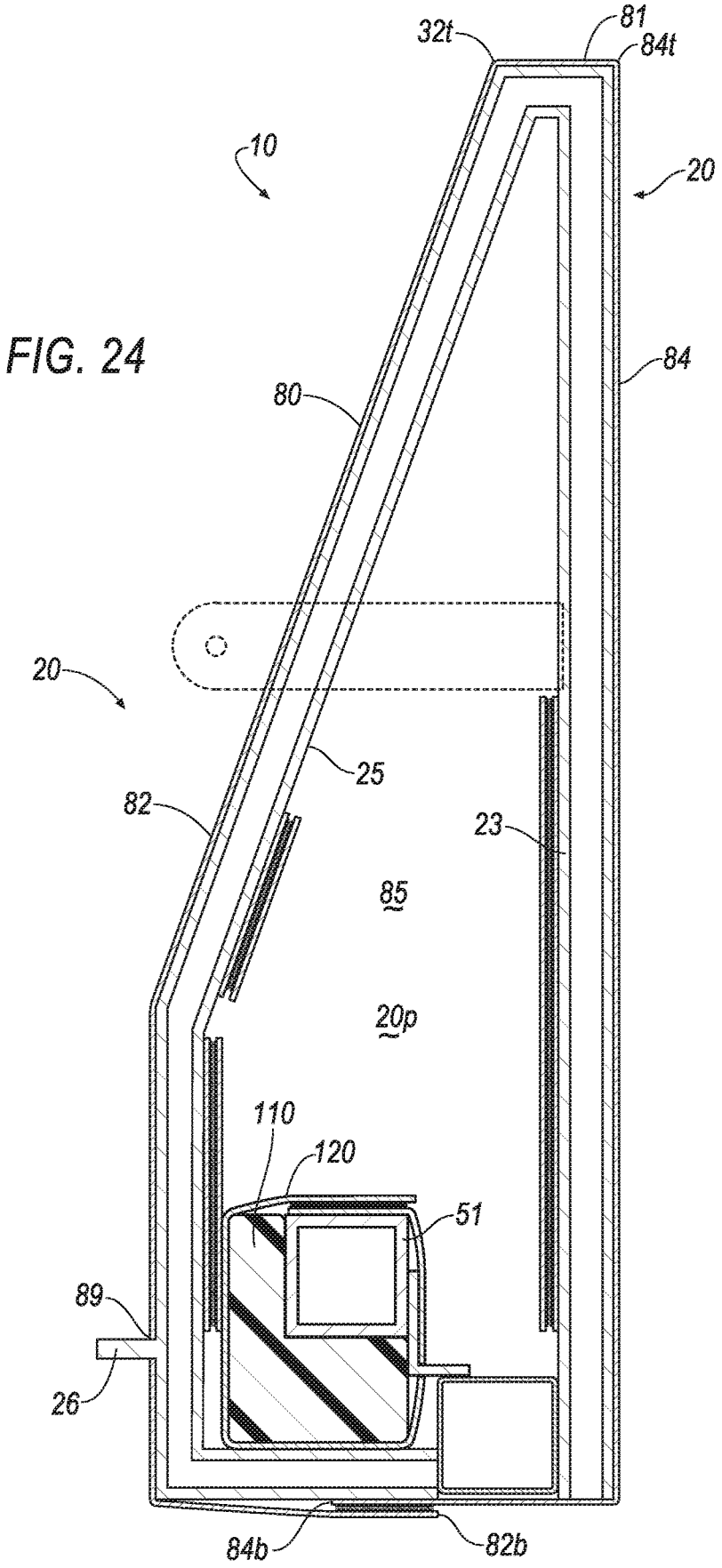
FIG. 24 is a cross section view of the example front assembly of FIG. 21 disposed within the example back assembly of FIG. 13.

The bottom edge 84*b* of the back panel 84 may be releasably secured to the bottom edge 82*b* of the front panel 82, e.g., with Velcro, magnets, etc., as shown in FIGS. 14 and 24. As used herein, releasably secured means that components may be repeatedly secured to each other, and released from such securement, without the use any tooling or destructive methods.

The back panel 84 may have a pair of opposing side edges 84*s*. The side edges 84*s* may be secured to the side panels 83, e.g., via stitching, etc. Alternately, the side edges 84*s* may be where the back panel 84 transitions to the side panels 83, e.g., when the back panel 84 and the side panels 83 are integral.

Each side panel 83 may have a top edge 83*t*. Each side panel 83 may be secured to the top panel 81 at the top edge 83*t*, e.g., via stitching, etc. Alternately, the top edge 83*t* may be where the side panel 83 transitions to the top panel 81, e.g., when the side panels 83 and the top panel 81 are integral.

Each side panel 83 may include a bottom edge 83*b* opposite the top edge 83*t*. The top edge 83*t* may be spaced from the bottom edge 83*b* by a distance D3, as shown in FIGS. 11 and 12. The distance D3 between the top edge 83*t* and the bottom edge 83*b* of each side panel 83 may be less than the distance D1 between the top edge 82*t* and the bottom edge 82*b* of the front panel 82. The distance D3 between the top edge 83*t* and the bottom edge 83*b* of each side panel 83 may be less than the distance D1 between the top edge 84*t* and the bottom edge 84*b* of the back panel 84.

Each side panel 83 may have a pair of opposing side edges 83*s*. Each of the side edges 83*s* may be secured to the front or the back panels 82, 84, e.g., via stitching, etc. Alternately, the side edges 83*s* may be where the back panel 84 transitions to the side panel 83 and/or where the front panel 82 transitions to the side panel 83, e.g., when the side panel 83, the back panel 84 and/or the front panel 82 are integral.

The covering 80 may include a plurality of pairs of flaps 86. One pair of flaps 86 may be secured to each side edge 84*s* of the back panel 84, e.g., via stitching, etc. Alternately, one pair of flaps 86 may extend from each side edge 84*s* of the back panel 84 and be internally formed with the back panel 84. Two pairs of flaps 86 may be secured to each side edge 82*s* of the front panel 82, e.g., via stitching, etc. Alternately, two pairs of flaps 86 may extend from each side edge 82*s* of the front panel 82 and be internally formed with the front panel 82. The two pairs of flaps 86 on each side edge 82*s* of the front panel 82 may be spaced from each other.

Each flap 86 of each of the pairs of flaps 86 may be releasably secured to the other flap 86 of the pair of flaps 86, e.g., with Velcro, magnets, etc. The pairs of flaps 86 may be disposed around the support beams 23, 25. For example, one pair of flaps 86 may be disposed around the support beam 23. For example, one pair of flaps 86 may be disposed around the first linear portion 25*f* of the support beam 25, and another pair of flaps 86 may be disposed around the second linear portion 25*s* of the support beam 25.

The covering 80, e.g., the front panel 82 and the back panel 84, may define the cavity 85. The cavity 85 may be further defined by the side panels 83 and/or the top panel 81. The support beams 23, 25 may be disposed within the cavity 85.

The covering 80 of the back assembly 20 may defines an opening 88. The opening 88 provides access to the cavity 85. The opening 88 may be defined by the bottom edge 83*b* of one of the side panels 83, one of the side edges 82*s* of the front panel 82, e.g., a portion of such side edge 82*s* that extends between the bottom edge 83*s* of the side panel 83 and the bottom edge 82*b* of the front panel 82, and one of the side edges 84*s* of the back panel 84, e.g., a portion of such side edge 84*s* that extends between the bottom edge 83*s* of the side panel 83 and the bottom edge 84*b* of the back panel 84.

The covering 80 may include a plurality of slits 89. The slits 89 define an opening. It is to be understood that the covering 80 may have openings that have a shape other than the slits 89, e.g. round, etc. Each frame support 26 may be disposed within one of the slits 89, or other shaped openings. To put it another way, each frame support 26 may extent from inside the cavity 85 to outside the cavity 85 via one of the slits 89, or other shaped openings.

The side assembly 30, shown in FIGS. 1-10, 15-16, and 18-20, includes an upper beam 31, a lower beam 32, a front beam 33, a rear beam 34, front beam receiving structures 35*f*, rear beam receiving structures 35*r*, and a side plate 39. The upper beam 31, lower beam 32, front beam 33 and rear beam 34 are all secured to each other, e.g., via welding, to provide the side assembly 30 with a generally rectangular shape. The front member receiving structure 35*f* and rear member receiving structure 35*r* are located at the lower beam 32 and the relative front beam 33 and rear beam 34 such that opposing distal ends of the lower beam 32 are secured to the member receiving structures 35*f*, 35*r* with the member receiving structures 35*f*, 35*r* secured to the relative front beam 33 and rear beam 34, e.g., via welding.

The member receiving structures 35*f*, 35*r* may have an elongate hollow rectangular shape defining a front opening 37*f* and a rear opening 37*r*, respectively. Holes 35*h* may be located in a bottom portion of the member receiving structures 35*f*, 35*r*.

A front support plate 40*f* may be secured to the front member receiving structure 35*f*, the front beam 33 and lower beam 32, e.g., via welding. A rear support plate 40*r* is secured to the rear member receiving structure 35*r*, the rear beam 34 and lower beam 32, e.g., via welding. The support plates 40*f*, 40*r* have a planar L-shape. The receiving structures 35*f*, 35*r* are secured to the edges of the support plates 40*f*, 40*r* adjacent the inside corner of the L-shape. The beams 32, 33, 34 are secured to the edges at the ends of the L-shape adjacent the edges secured to the receiving structures 35*f*, 35*r*.

The side plate 39 may be planar in form and have a generally rectangular shape with a rounded half circle end. The side plate 39 may extend downward from the upper beam 31. A hole 39*h* may be located in each side plate 39 at the rounded half circle end. The hole 39*h* may be threaded, and/or may be supported by a reinforcement portion 28, for example a weld nut secured to the side plate 39 such that an axis of the nut and an axis of the hole 39*h* align.

Each side assembly 30 may include a core 90, shown in FIGS. 15-18. The cores 90 may be made of foam, such as expanded polypropylene or other suitable material, such as wood, cardboard, plastic, etc. Each core 90 may include a front surface 91, a back surface 92, a top surface 93, a bottom surface 94 and a pair of opposing side surfaces 95. The top surface 93 may be opposite the bottom surface 94. The front surface 91 may be opposite the back surface 92. The sides surfaces 95 may be opposite each other and extend between front surface 91 and the back surface 92 and between the top surface 93 and the bottom surface 94.

Each core 90 may be disposed between the upper beam 31, the lower beam 32, the front beam 33, and the rear beam 34 of one of the side assemblies 30. The top surface 93 may abut the upper beam 31. The bottom surface 94 may abut the lower beam 32. The front surface 91 may abut the front beam 33. The back surface 92 may abut the rear beam 34.

Each of the cores 90 may define a recessed channel 96. The recessed channel 96 may extend from the top surface 93 along one of the side surfaces 95. The recessed channel 96 may have a complementary shape to the side plate 39 of the side assembly 30, e.g., the recessed channel 96 may have a generally rectangular shape with a rounded half circle end. The side plate 39 of one of the side assemblies 30 may be disposed with the recessed channel 96 of one of the foam cores 90.

Each of the foam cores 90 may include one or more notches 97. One of the notches 97 may be located at the front surface 91 and the bottom surface 92. One of the notches 97 may be located at the back surface 92 and the bottom surface 94. The notches 97 may have a complementary shape to the front receiving structure 35*f* and/or the rear receiving structure 35*r*. For example, the notches 97 may be rectangular. The front receiving structure 35*f* and/or the rear receiving structure 35*r* may each be disposed within one of the notches 97.

Each side assembly 30 may include a covering 100. Each covering 100, shown in FIGS. 4, 9, 15, and 18-20 may include a pair of opposing side panels 101, a top panel 102, a front panel 103, and a back panel 104.

The panels 101, 102, 103, 104 may be formed of leather, fabric, or and other suitable material. The panels 101, 102, 103, 104 may include a foam layer secured to the leather, fabric, etc., e.g., via stitching, adhesive etc. Two or more of the panels 101, 102, 103, 104 may be internally formed, e.g., formed from a same piece of fabric, leather, etc.

The front panel 103 may have a top edge 103*t*. The front panel 103 may be secured to the top panel 102 at the top edge 103*t*, e.g., via stitching, etc. Alternately, the top edge 103*t* may be where the front panel 103 transitions to the top panel 102, e.g., when the front panel 103 and the top panel 103 are integral. The front panel 103 may include a bottom edge 103*b* opposite the top edge 103*t*.

The front panel 103 may have a pair of opposing side edges 103*s*. The side edges 103*s* may be secured to the side panels 101, e.g., via stitching, etc. Alternately, the side edges 103*s* may be where the front panel 103 transitions to the side panels 101, e.g., when the front panel 103 and the side panels 101 are integral.

The back panel 104 may have a top edge 104*t*. The back panel 104 may be secured to the top panel 102 at the top edge 104*t*, e.g., via stitching, etc. Alternately, the top edge 104*t* may be where the back panel 104 transitions to the top panel 102, e.g., when the back panel 104 and the top panel 102 are integral.

The back panel 104 may include a bottom edge 104*b* opposite the top edge 104*t*.

The back panel 104 may have a pair of opposing side edges 104*s*. The side edges 104*s* may be secured to the side panels 101, e.g., via stitching, etc. Alternately, the side edges 104*s* may be where the back panel 104 transitions to the side panels 101, e.g., when the back panel 104 and the side panels 101 are integral.

Each side panel 101 may have a top edge 101*t*. Each side panel 101 may be secured to the top panel 104 at the top edge 101*t*, e.g., via stitching, etc. Alternately, the top edge 101*t* may be where each side panel 101 transitions to the top panel 102, e.g., when the side panels 101 and the top panel 102 are integral.

Each side panel 101 may include a bottom edge 101*b* opposite the top edge 101*t*.

Each side panel 101 may have a pair of opposing side edges 101*s*. Each of the side edges 101*s* may be secured to the front panel 103 or the back panel 104, e.g., via stitching, etc. Alternately, the side edges 101*s* may be where the back panel 104 transitions to the side panel 101 and/or where the front panel 103 transitions to the side panel 101, e.g., when the side panel 101, the back panel 104 and/or the front panel 103 are integral.

Each side panel 101 may include one or more notches 105. The notches 105 provide access to the member receiving structures 35*f*, 35*r*. The notches 105 may extend from the bottom edge 101*b* towards the top edge 101*t*. The notches 105 may have a complementary shape to the openings 37*f*, 37*r*. The notches 105 may be rectangular. One of the notches 105 may be located proximate the front panel 103, i.e., closer to the front panel 103 than to the back panel 104. One of the notches 105 may be located proximate the back panel 104, i.e., closer to the back panel 104 than to the front panel 103.

One of the side panels 101 may include a hole 101*h*. The hole 101*h* may be proximate the back panel 104. The hole 101*h* may be proximate the top edge 101*t*, i.e., closer to the top edge 101*t* than to the bottom edge 101*b*. The hole 101*h* may axially align with hole 39*h* of the side plate 39. It is to be understood that such alignment is subject to tolerances based on the flexible nature of the side panels 101.

The covering 100 may include a pair flaps 106. One of the flaps 16 may be secured to the bottom edge 101*b* of one of the side panels 101, e.g., via stitching, etc. Alternately, one of the flaps 16 may extend from the bottom edge 101*b* of one of the side panels 101 and be internally formed with such side panel 101. Another of the flaps 106 may be secured to the bottom edge 101*b* of the other side panel 101, e.g., via stitching, etc. Alternately, such flap 106 may extend from the bottom edge 101*b* of the other side panel 101 and be internally formed with such side panel 101. The pair of flaps 106 may be located between the notches 105.

The flaps 106 may be releasably secured to each other, e.g., with Velcro, magnets, etc.

It is to be understood that as an alternative to the pair of flaps 106, a single flap may extend from the bottom edge 101*b* of one of the side panels 101 and releasably secure to the other of the side panels 101.

Figure 20:
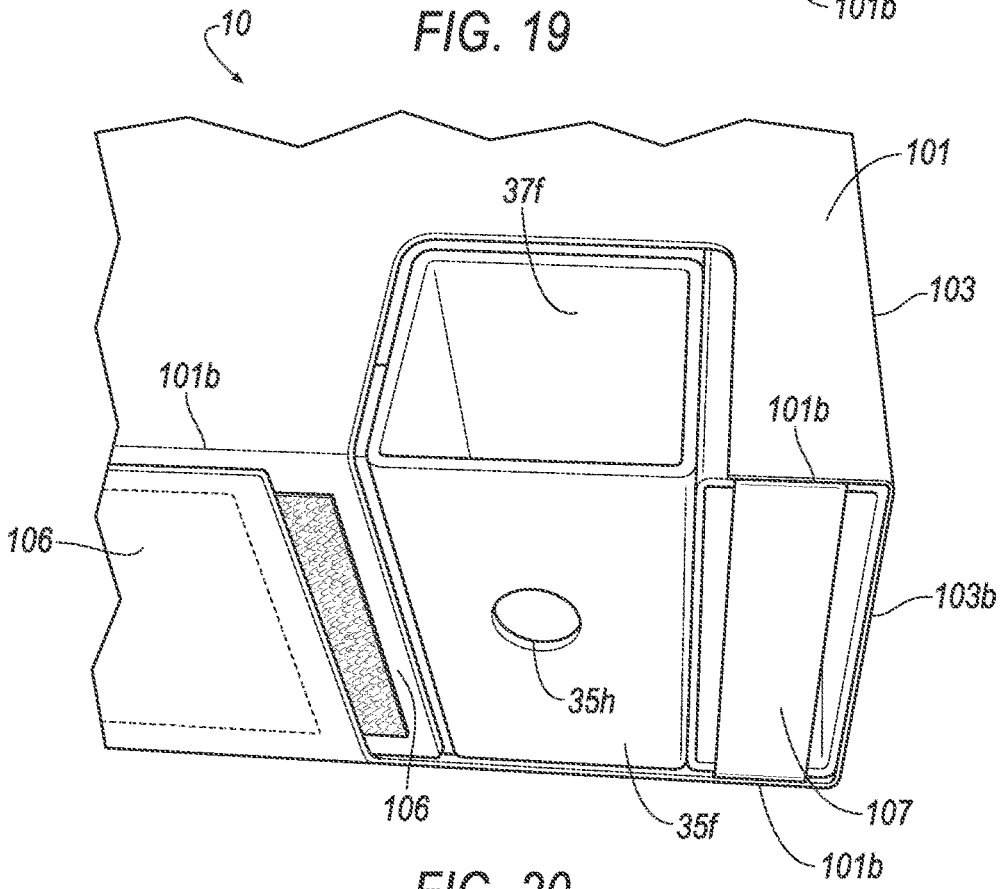
FIG. 20 is a close-up perspective view of a portion of the example side assembly of FIG. 15 with an alternate covering.
Figure 21:
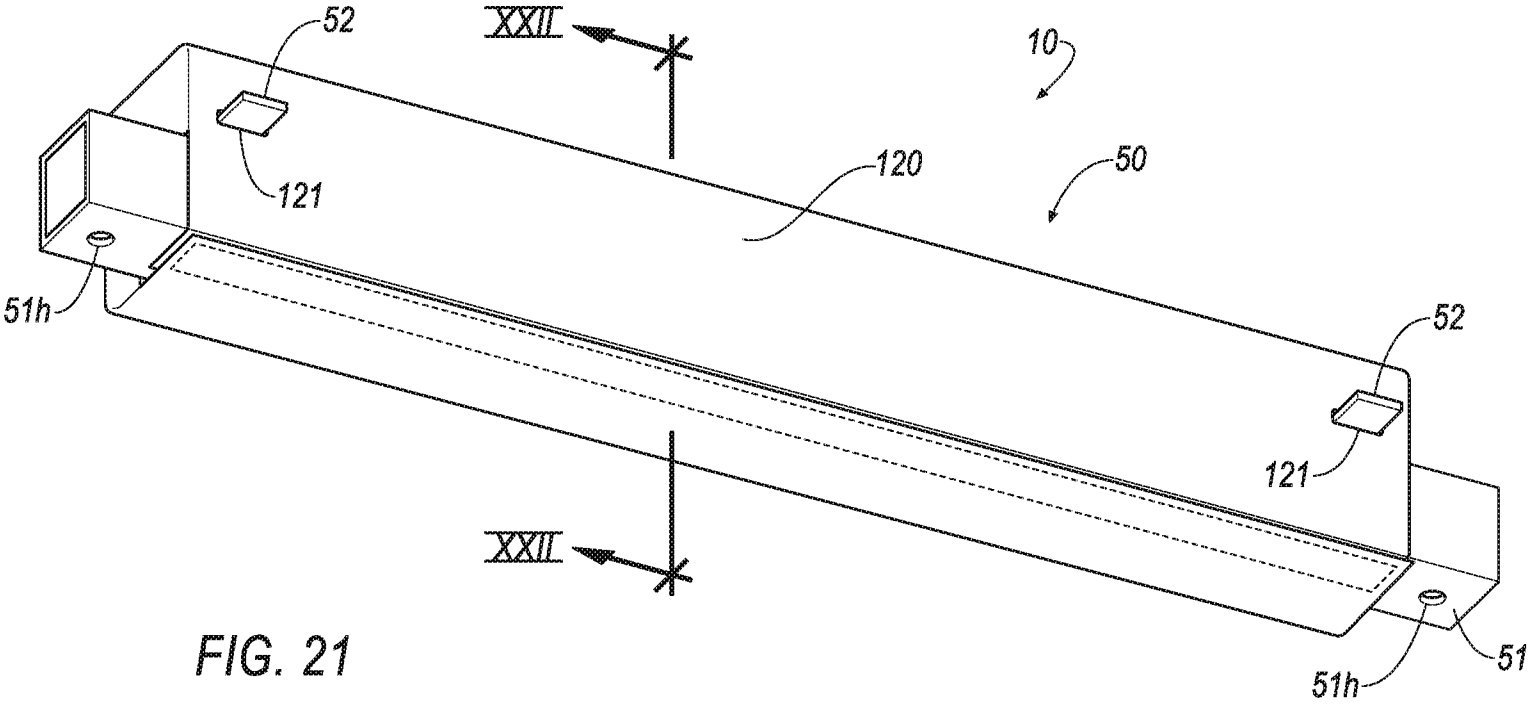
FIG. 21 is a perspective view of an example front assembly of the example piece of seating furniture of FIG. 1.
Figure 22:
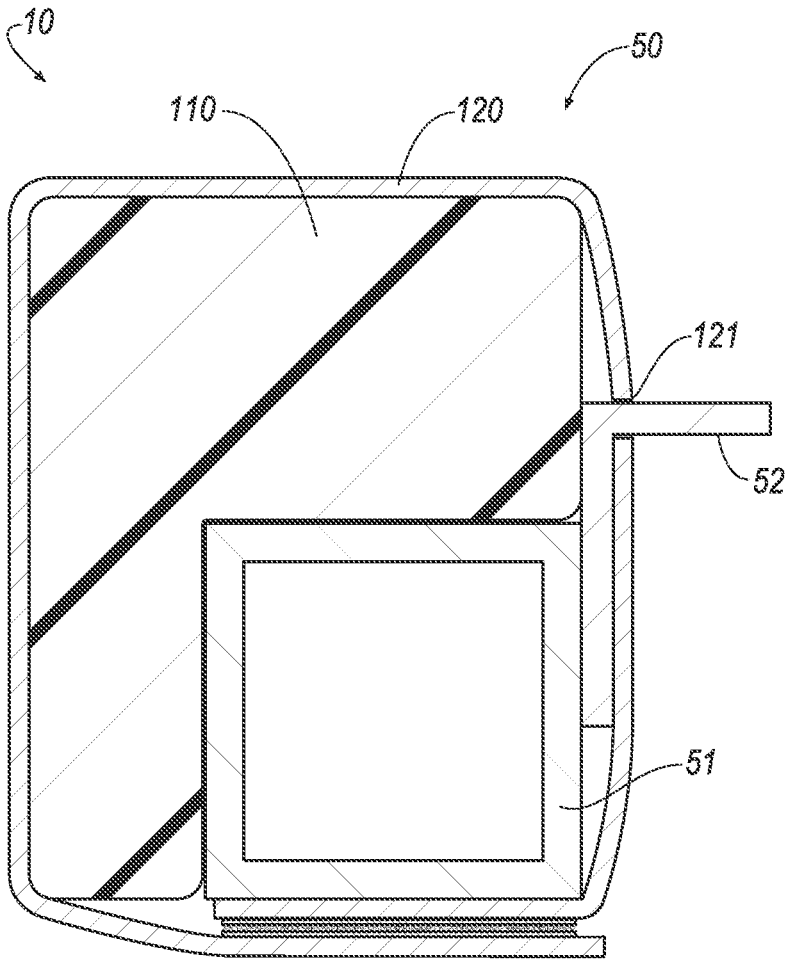
FIG. 22 is a cross section view of the example front assembly of FIG. 21.

The covering 100 may include one or more tethers 107, as shown in FIG. 20. The tethers 107 may extend between the pair of side panels 101. For example, one end of each tether 107 may be secured to the bottom edge 101*b* of one of the side panels 101, and an opposite end of each tether 107 may be secured to the bottom edge 101*b* of the other side panel 101. One of the tethers 107 may be located proximate the front panel 103, e.g., between the notch 105 proximate the front panel 103 and the bottom edge 103*b* of the front panel 103. One of the tethers 107 may be located proximate the back panel 104, e.g., between the notch 105 proximate the back panel 104 and bottom edge 104*b* of the back panel 104. The tethers 107 may be formed of fabric or other suitable material. The tethers 107 may be elastic.

The covering 100 may include one or more bottom panels 108. The bottom panels 108 may be secured to and extend between the bottom edges 101*b* of the side panels 101. One of the bottom panels 108 may be secured to the bottom edge 103*b* of the front panel 103. One of the bottom panels 108 may be secured to the bottom edge 104*b* of the back panel 104.

Figure 15:
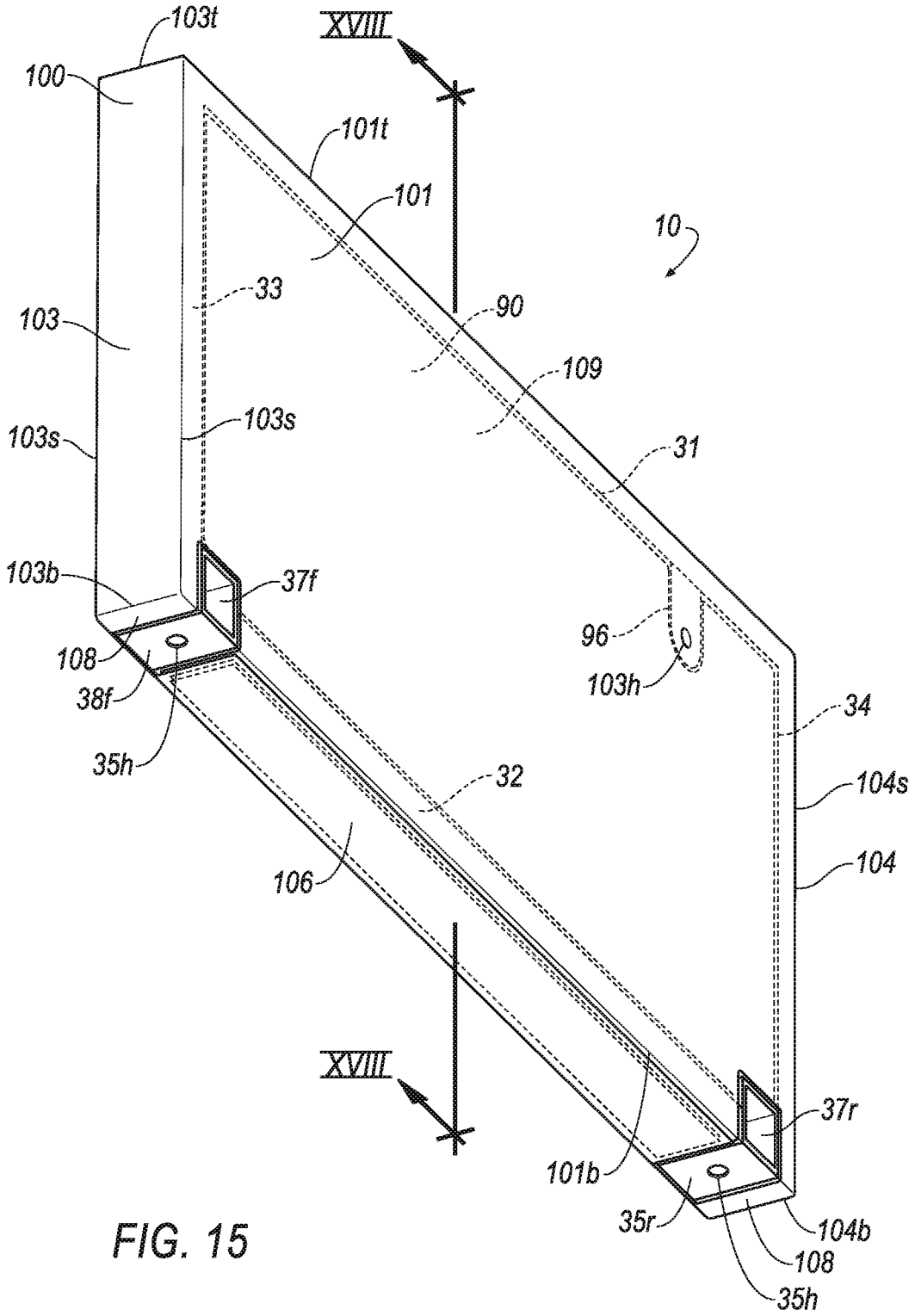
FIG. 15 is a side-bottom perspective view of an example side assembly of the example piece of seating furniture of FIG. 1.
Figure 16:
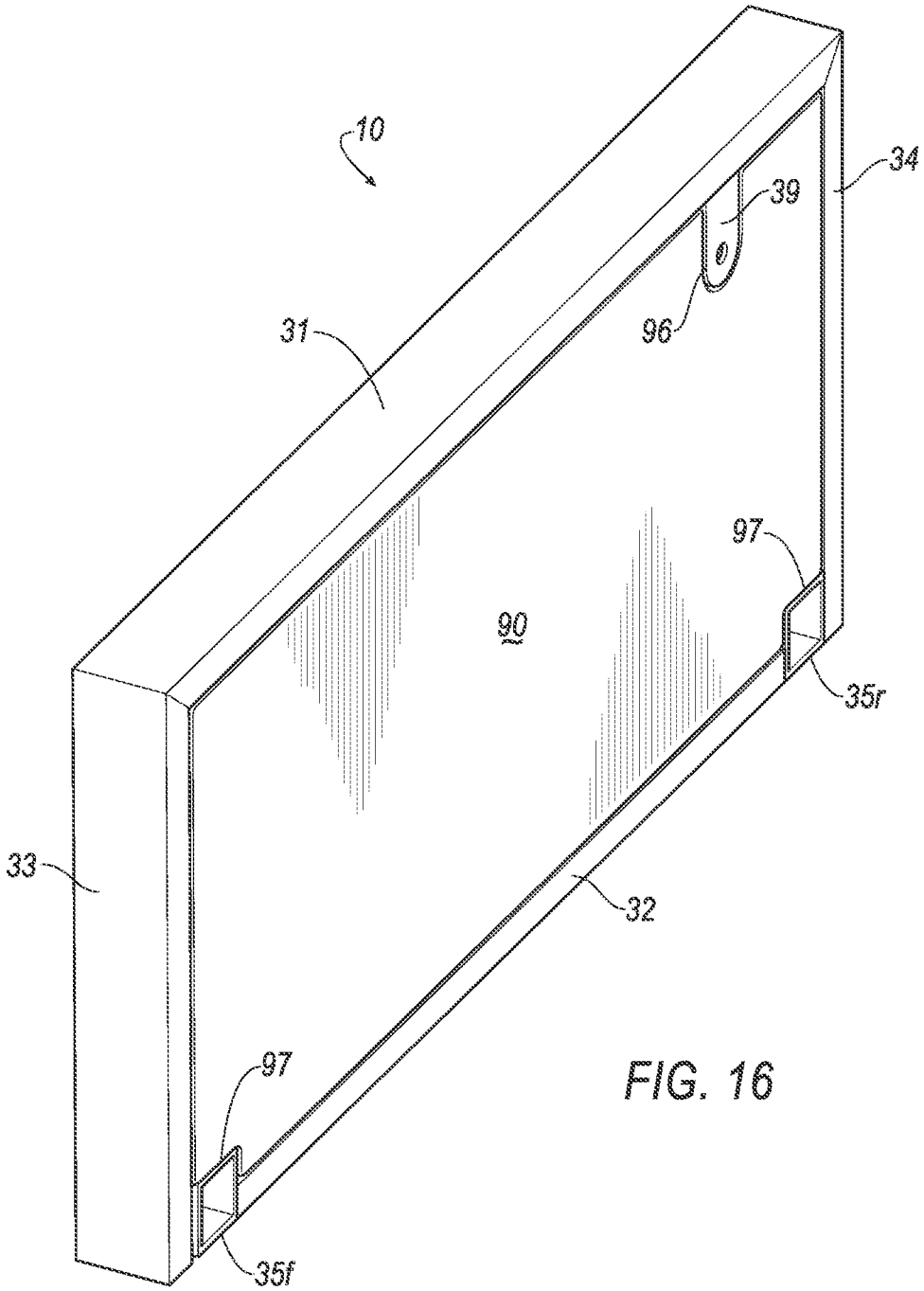
FIG. 16 is a side-top perspective view of the example side assembly of FIG. 15 without an example covering.
Figure 17:
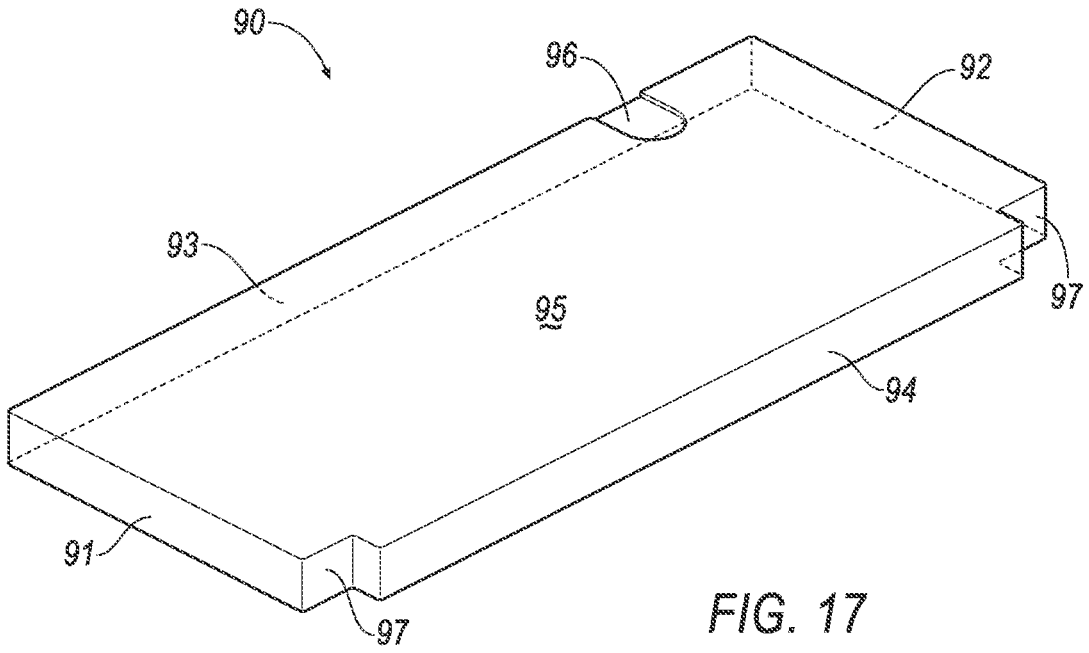
FIG. 17 is a side-bottom perspective view of an example core of the example side assembly of FIG. 15.
Figure 18:
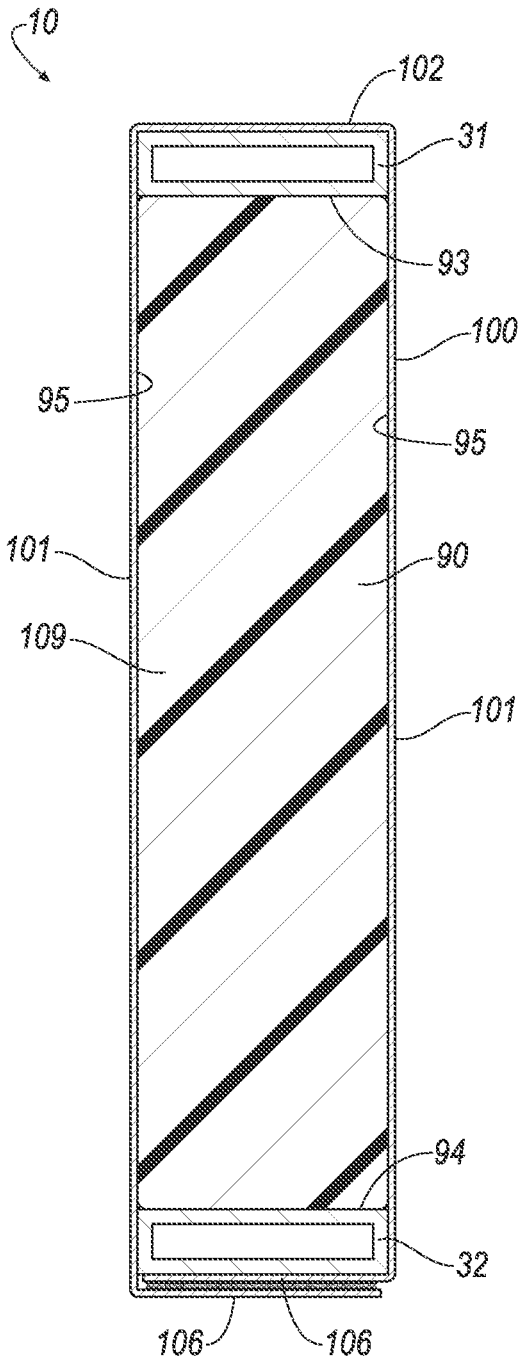
FIG. 18 is a cross section view of the example side assembly of FIG. 15.
Figure 19:
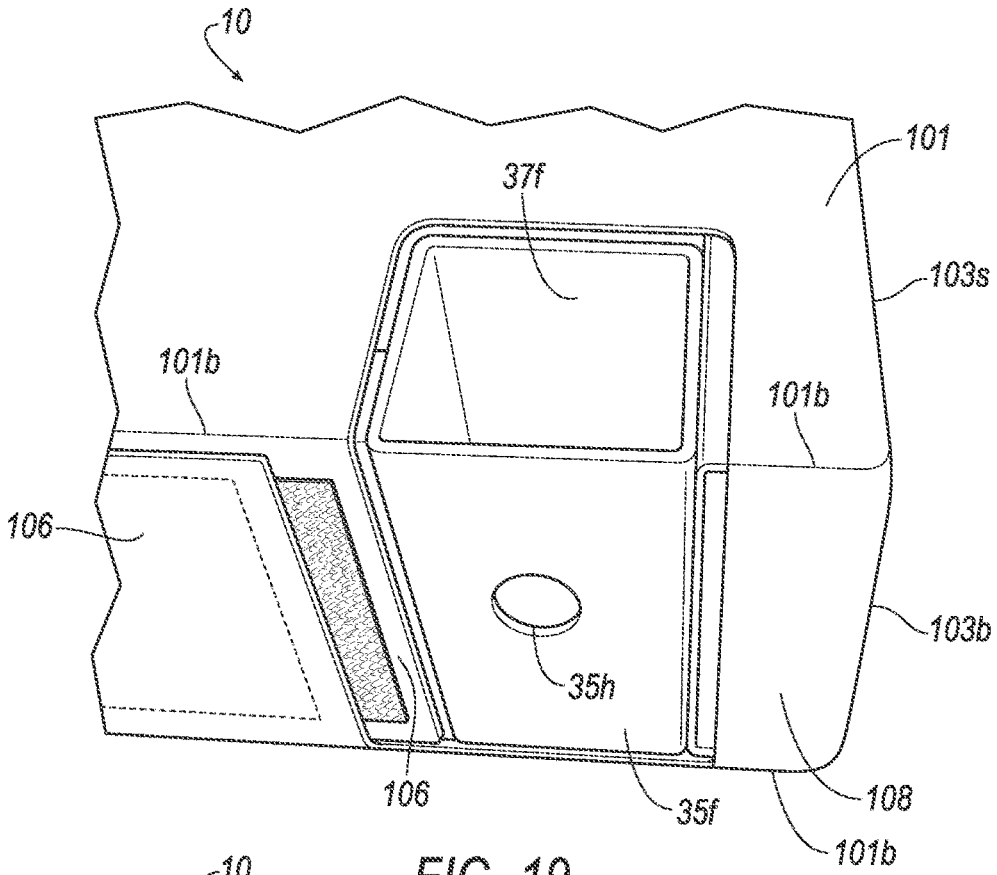
FIG. 19 is a close-up perspective view of a portion of the example side assembly of FIG. 15.

The covering 100 may define a cavity 109, shown in FIGS. 15 and 19. For example, the cavity 109 may be defined by the pair of opposing side panels 101, the top panel 102, the front panel 103, the back panel 104 and/or the pair of flaps 106.

The upper beam 31, the lower beam 32, the front beam 33, the rear beam 34, and/or the core 90 may be disposed within the cavity 109.

The front assembly 50, shown in FIGS. 1-6, 9, 10, and 21-24, may include a front beam 51, and a pair of suspension frame supports 52.

The front beam 51 may be a single piece front member elongated between the distal ends 53 and have a hollow square cross section. Alternately, the front beam may be a multi-piece front member, e.g., with a distal end of each piece extending from opposing sides of the front assembly and the multiple pieces of the front beam connected by additional rear assembly frame components (not shown).

The distal ends 53 may be designed to be received by the side assemblies 30. For example, the distal ends 53 may be rectangular and sized to be fit within the front beam receiving structures 35*f*. A hole 51*h* is located in the front beam 51 proximate each distal end 53. The interior surface of the hole 51*h* may be threaded. The beam 51 may include a reinforcement portion 28, for example a weld nut secured to the interior of the front beam 51 such that an axis of the nut and an axis of the hole 51*h* align.

The frame supports 52 have an elongated L-shape with a pair of planar square surfaces joining at a generally perpendicular angle. One of the surfaces of each frame support 52 is secured to the front beam 51, e.g., via welding. The other surface of each frame support 52 extends away from the front beam 51.

The distal ends 53 of the front beam 51 may secure the side assembly 30 to the front assembly 50. For example, the distal ends 53 may be disposed within the front beam receiving structures 35*f*.

The front assembly 50 may include a cushion 110. The cushion 110 may have an elongated L-shape. The cushion 110 may be made of foam, such as expanded polypropylene or other suitable material. The cushion 110 may be elongated along the front beam 51. The front beam 51 may be disposed within an inside corner of the L-shape of the cushion 110.

The front assembly 50 may include a covering 120. The covering 120 may be formed of leather, fabric, or and other suitable material. The covering 120 may include a foam layer secured to the leather, fabric, etc., e.g., via stitching, adhesive etc. The front beam 51 and the cushion 110 may be disposed within the covering 120.

The covering 120 may include one or more slits 121. The frame supports 52 may be disposed within the slits 121. The slits 121 define an opening. It is to be understood that the covering 120 may have openings that have a shape other than the slits 121, e.g. round, etc.

Figure 23:
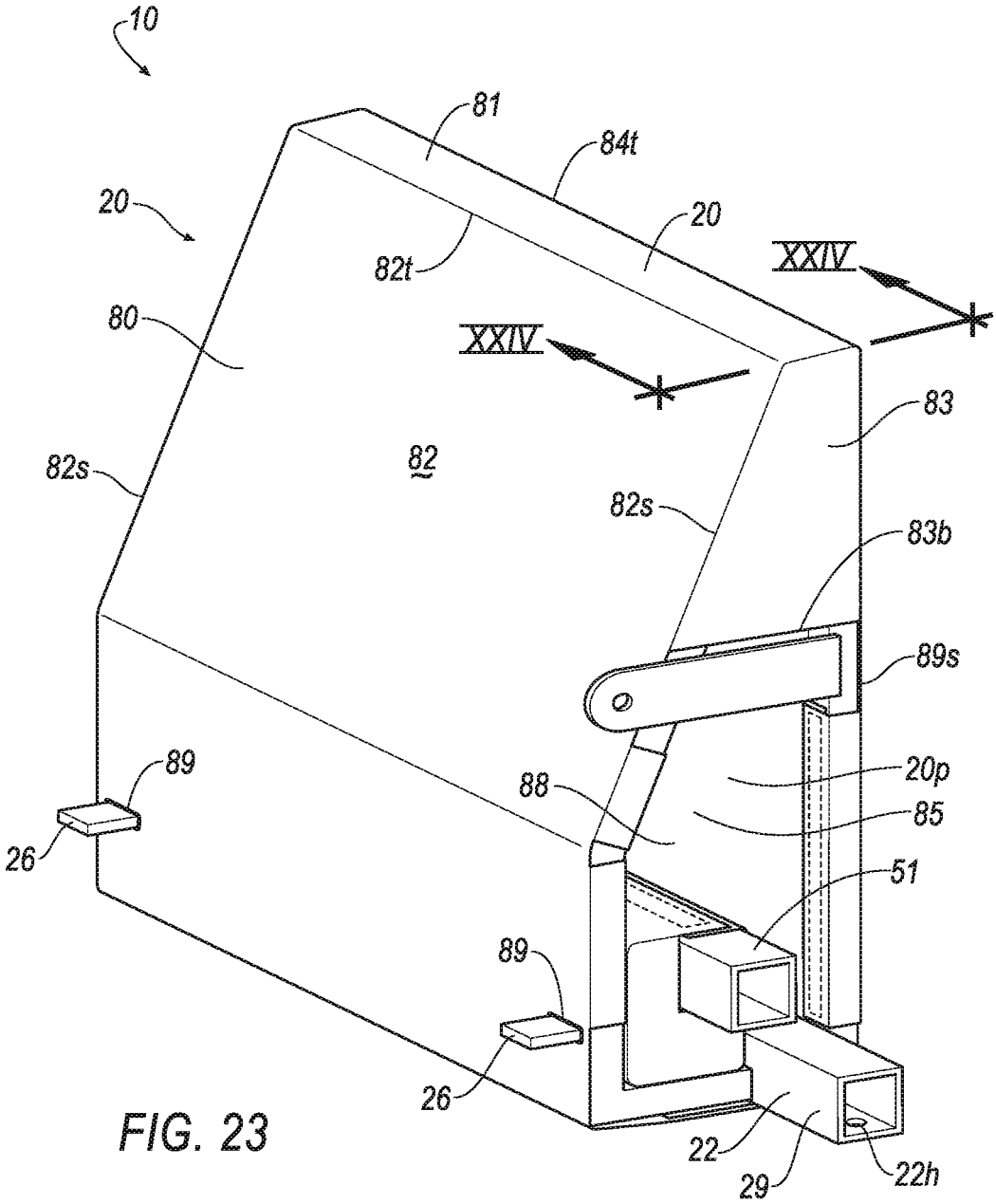
FIG. 23 is a perspective view of the example front assembly of FIG. 21 disposed within the example back assembly of FIG. 13.

The front assembly 50, including the cushion 110 and the covering 120 may disposed within the passage 20*p*, e.g., when the seating furniture 10 is in the disassembled state, as shown in FIGS. 23 and 24. The front assembly 50, including the cushion 110 and the covering 120 may disposed within the cavity 85, e.g., when the seating furniture 10 is in the disassembled state. The front assembly 50 within the cavity 85 may be accessible via the opening 88. For example, the front assembly 50 may pass through the opening 88 to be placed within, or removed from, the cavity 85.

The legs 60, shown in FIGS. 1-10, include a main body 61 and an attachment member 62. The main body 61 may have a frusto-conical shape. The attachment member 62 extends from main body 61. The attachment member 62 may have a threaded shaft.

In the assembled state, each distal end 29 of the rear beam 22 is received by the rear openings 37*r* of the side assemblies 30, and aligned such that the hole 22*h* in the distal end 29 aligns with the hole 35*h* in the receiving structures 35*r*. The attachment member 62 is received in the hole 22*h* in the distal end 29 of the rear beam 22 and in the hole 35*h* in the receiving structure 35*r*. The threaded shaft of attachment member 62 engages the reinforcement portion 28, e.g., the weld nut, to secure the leg 60, rear assembly 20 and side assembly 30 together.

Figure 6:
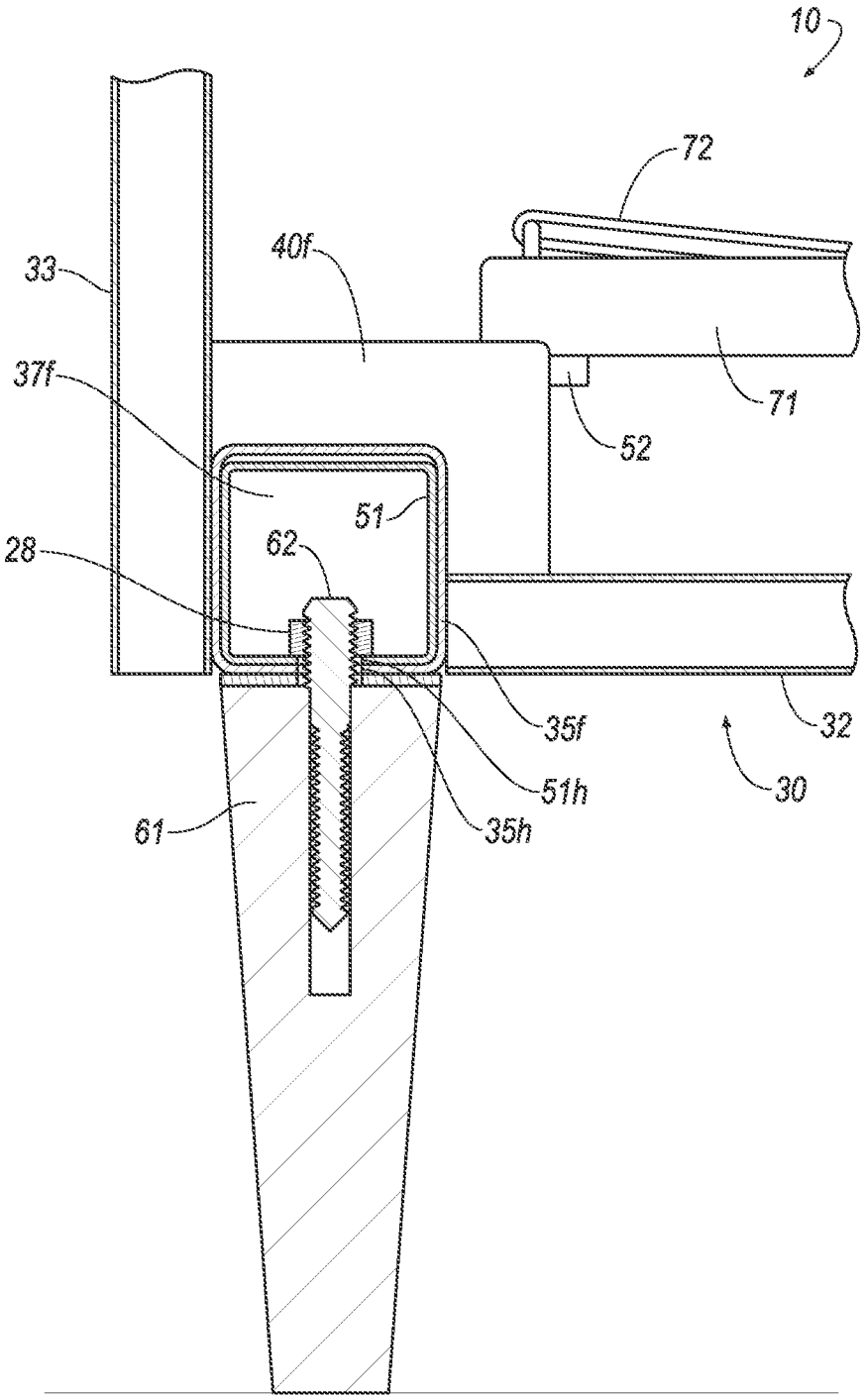
FIG. 6 is a close-up side cross section view of a portion of the frame of the example piece of seating furniture of FIG. 1.
Figure 7:
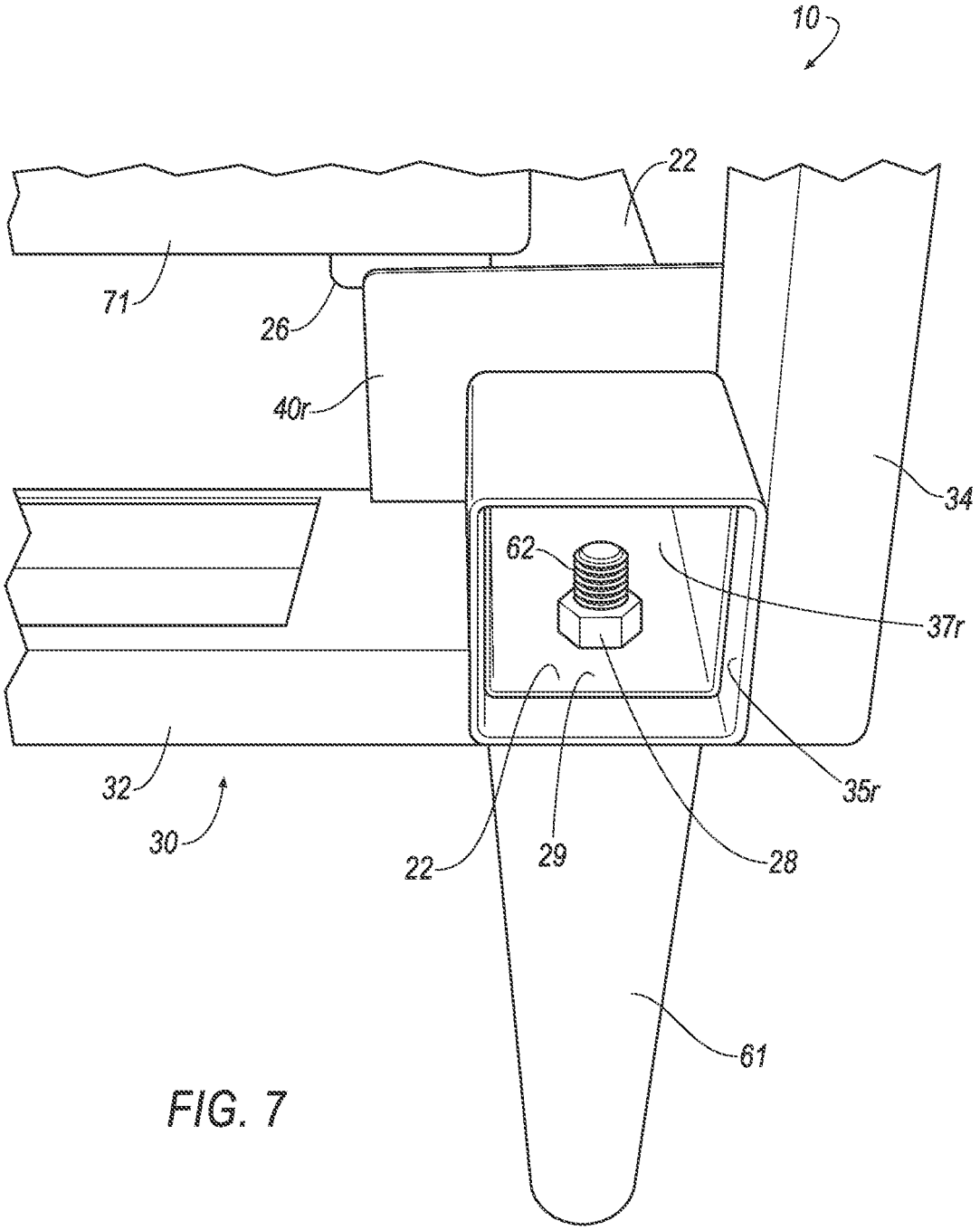
FIG. 7 is a close-up perspective view of a portion of the frame of example piece of seating furniture of FIG. 1.
Figure 8:
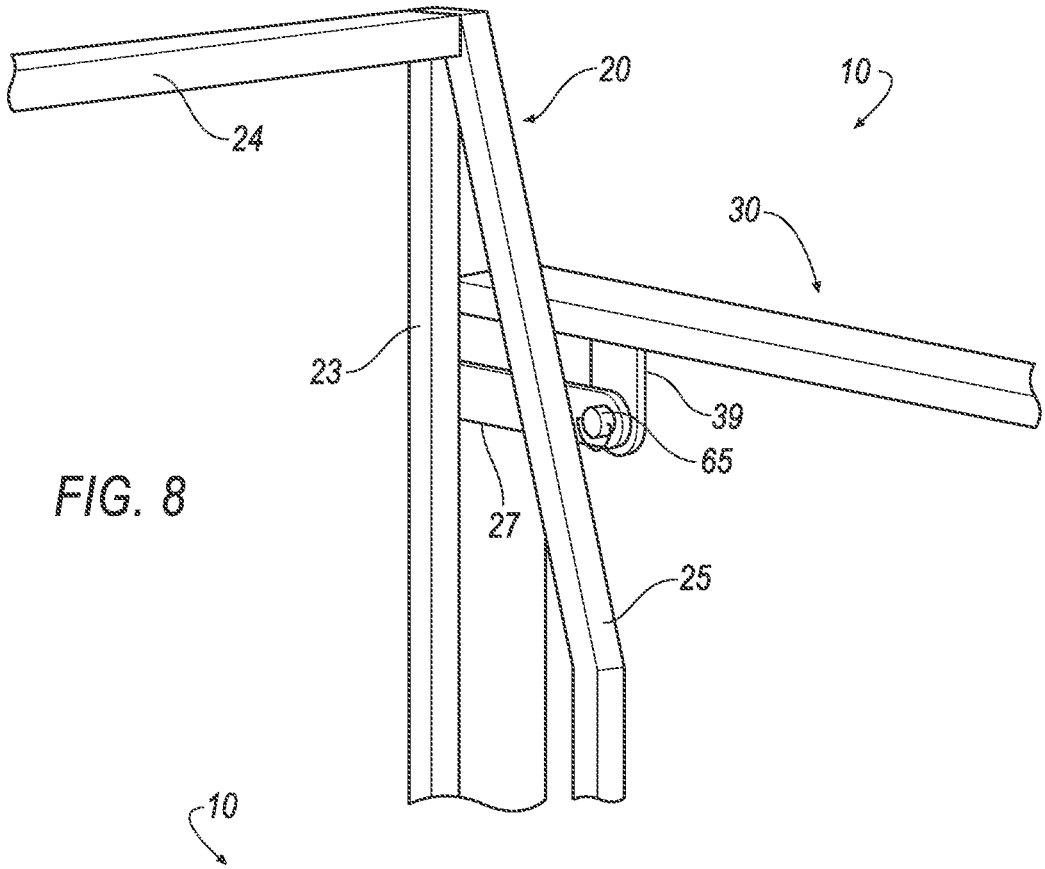
FIG. 8 is a close-up perspective view of another portion of the frame of the example piece of seating furniture of FIG. 1.
Figure 9:
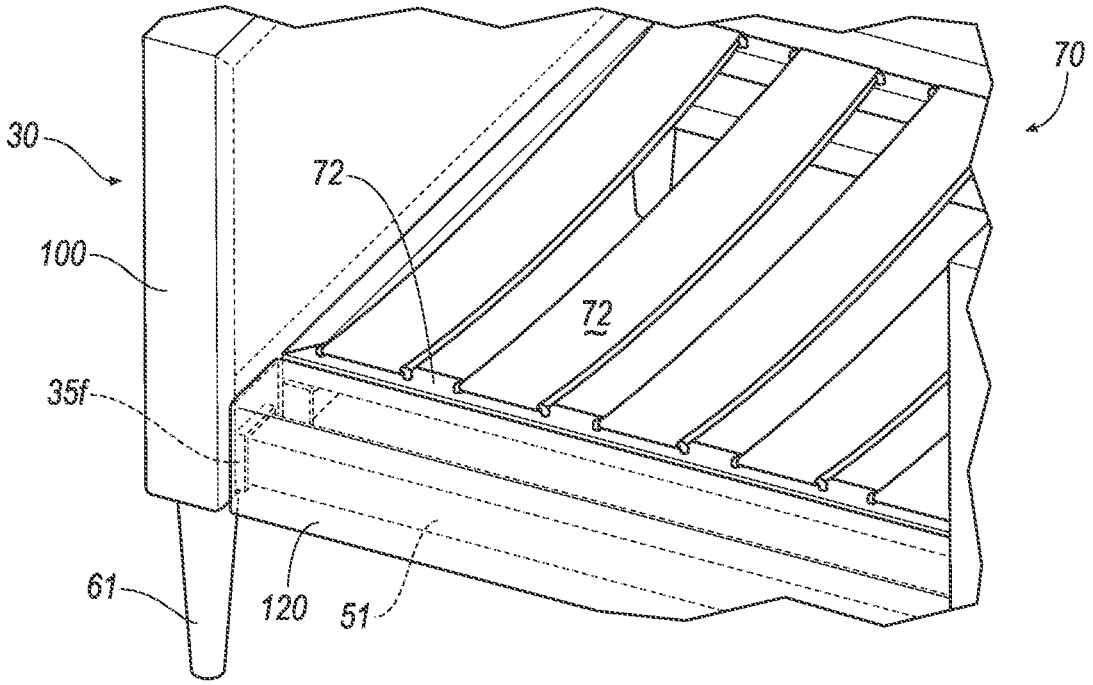
FIG. 9 is a close-up perspective view of a portion of the example piece of seating furniture of FIG. 1.
Figure 10:
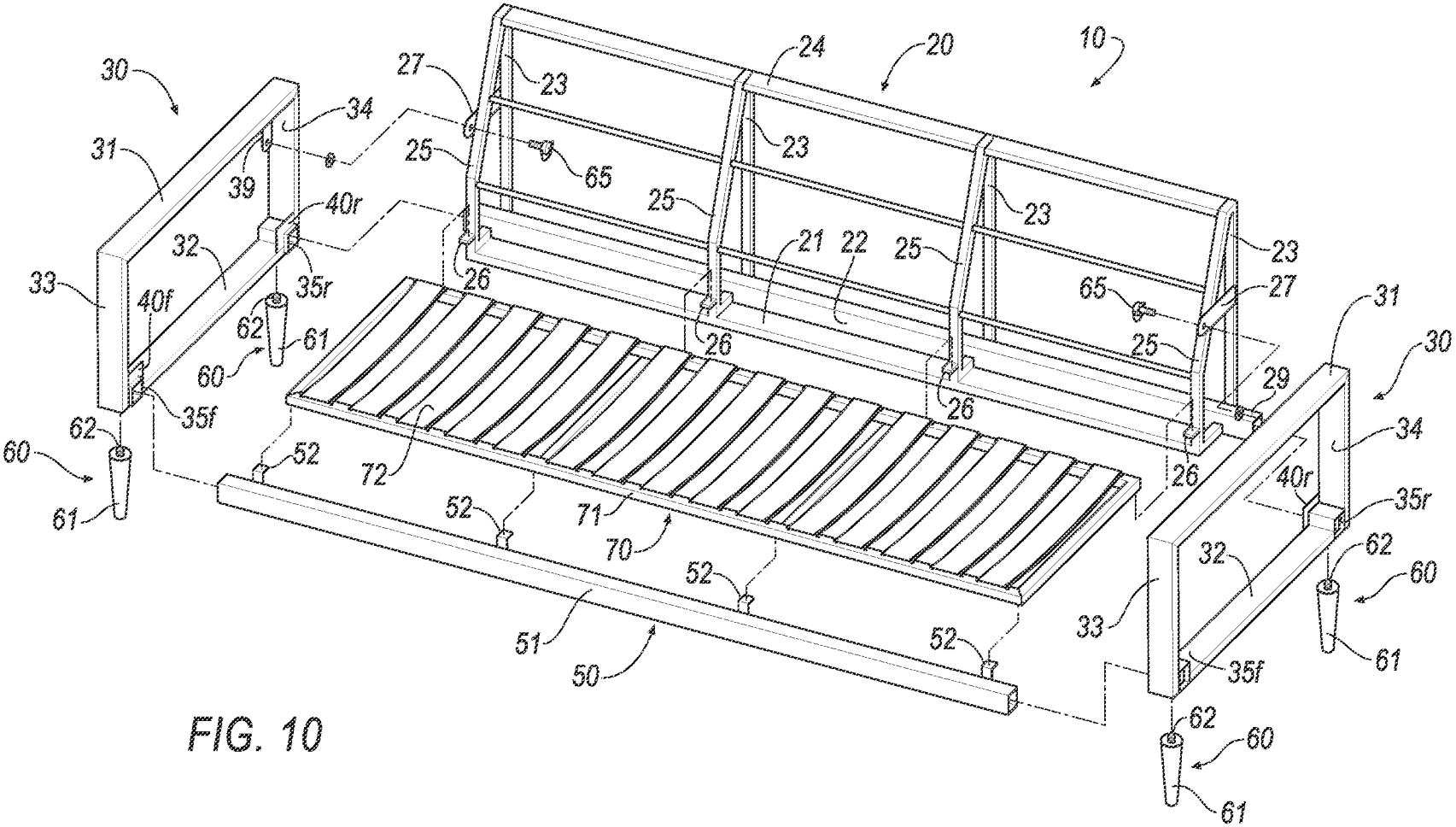
FIG. 10 is an exploded perspective view of assemblies forming a frame of an alternate example piece of seating furniture.

Similarly, in the assembled state, each distal end 53 of the front beam 51 is received in the front opening 37*f* in one of the side assemblies 30, being aligned and secured with legs 60, as described above. A cross sectional of the front beam 51 received in the front opening 37*f* is shown in FIG. 6, a cross section of the rear beam 22 in the rear opening 37*r* is substantially similar.

The front and rear receiving structures 35*f*, 35*r* are designed to receive the ends of the respective front beam 51 and rear beam 22. For example, the openings 37*f*, 37*r* may have an inner perimeter that is complimentary to an outer perimeter of the distal end 29, 53 of the relative beam 22, 51 such that the beam 22, 51 is a slip fit into the relative portion 35*f*, 35*r* without excessive rotation or translation therebetween.

In the assembled state, the hole 27*h* in the side plate 27 and the hole 39*h* in side plate 39 are axially aligned. A fastener, such as a D-ring screw 65 is received in the hole 37*h* in the side plate 27, and engages the threads in the hole 39*h* in the side plate 39 to further secure the side assembly 30 to the back assembly 20.

The back assembly 20 and front assembly 50 may be designed with various widths to provide the desired seating type, for example a chair, love seat or sofa.

The seating assembly 70 includes a suspension frame 71 and seating supports 72. The suspension frame 71 is rectangular in form, and dimensioned to rest on the frame supports 26, 52 abutting the back assembly 20, side assemblies 30, and front assembly 50. The seating support 72 may be flexible straps secured to and spanning the suspension frame 71. The seating assembly 70 may include one or more seating cushions supported by the seating supports 72.

Using only the steps detailed in the method below, the easy to assemble piece of seating furniture 10 may be assembled without the use of any additional parts or tools.

Figure 25:
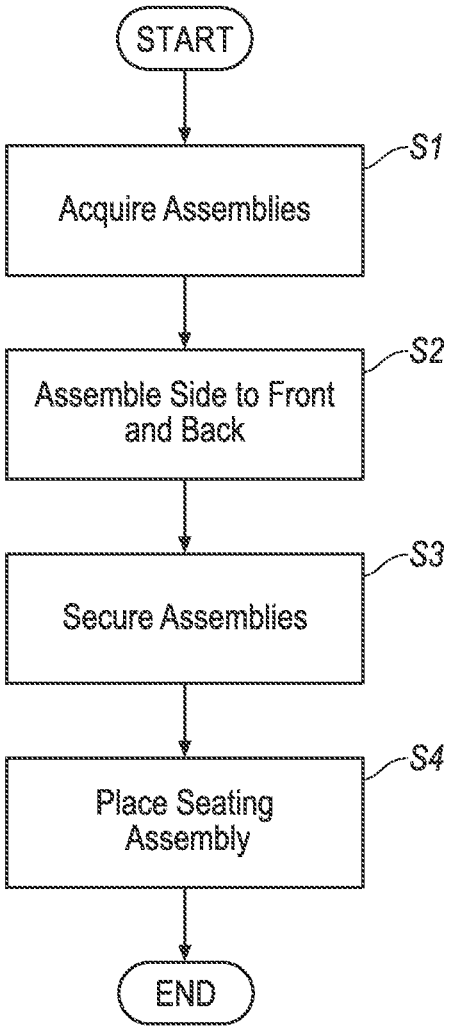
FIG. 25 is flow chart of steps to assemble the kit of FIG. 4.

With reference to FIG. 25, the method to assemble is as follows:

At step S1, the back assembly 20, side assemblies 30, front assembly 50, legs 60, and seating assembly 70 are acquired.

At step S2, the distal ends 29, 53 extending from the back assembly 20 and from the front assembly 50 are inserted into the openings 37*f*, 37*r* in the receiving structures 35*f*, 35*r*, of the side assemblies 30.

At step S3, the side assemblies 30 are secured to the rear assembly 20 and the to the front assembly 50. To provide such securement, holes 27*h* in the rear assembly 20 side plates 27 are aligned with holes 39*h* in the side assembly 30 side plates 39. D-ring screws 65 are engaged with the holes 27*h*, 39*h*. The distal ends 29, 53 extending from the back assembly 20 and from the front assembly 50 are placed in the openings 37*f*, 37*r* of the receiving structures 35*f*, 35*r*. The holes 51*h*, 35*h* are aligned and engaged with the attachment members 62 of the legs 60. The holes 51*h*, 22*h* are aligned and engaged with the attachment members 62 of the legs 60.

At step S4, the seating assembly 70 is placed on the frame supports 26, 52.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A kit for assembling a piece of seating furniture, the kit comprising:

a back assembly including a rear beam having a pair of opposing distal ends designed to be received by a pair of side assemblies, the back assembly including a plurality of support beams defining a passage; and a front assembly including a front beam having a pair of opposing distal ends designed to be received by the pair of side assemblies;

the front assembly being disposed within the passage, the opposing distal ends of the front assembly extending outside of the passage and beyond the back assembly.

2. The kit of claim 1, further comprising the pair of side assemblies, wherein each side assembly includes a member receiving structure designed to receive the distal end of the back assembly.

3. The kit of claim 2, wherein each side assembly includes a second member receiving structure designed to receive the distal end of the front assembly.

4. The kit of claim 3, wherein each side assembly includes an expanded polypropylene core.

5. The kit of claim 4, wherein the cores each define a recessed channel, and the side assemblies each include a side plate disposed within one of the recessed channels.

6. The kit of claim 5, wherein each of the side plates includes a hole, and each of the side assemblies includes a covering having a hole that aligns with the hole of the one of the side plates.

7. The kit of claim 4, wherein each of the cores includes a notch, and each of the member receiving structures is disposed within one of the notches.

8. The kit of claim 2, wherein each side assembly includes a covering having a pair of opposing side panels and a pair of flaps extending from opposing side panels, the flaps releasably securable to each other.

9. The kit of claim 8, wherein one of the side panels includes a pair of notches, and one of the flaps is disposed between the notches.

10. A kit for assembling a piece of seating furniture, the kit comprising:

a back assembly including a rear beam elongated between a pair of opposing distal ends designed to be received by a pair of side assemblies, the back assembly including a first pair of support beams extending upwardly away from the rear beam at a rear of the back assembly, the back assembly including a second pair of support beams extending upwardly away from the rear beam at a front of the back assembly, the back assembly including a base plate fixed to the rear beam, wherein the first pair of support beams and the second pair of support beams extend normally relative to a top surface the base plate, and wherein a passage is defined between the first pair of support beams, the second pair of support beams, and the base plate, the passage elongated between the distal ends; and a front assembly including a front beam having a pair of opposing distal ends designed to be received by the pair of side assemblies, the front assembly disposed within the passage.

11. The kit of claim 10, wherein the front assembly includes a covering disposed around the front beam and within the passage.

12. The kit of claim 11, wherein the covering includes a slit, and the front assembly includes a frame support secured to the front beam and disposed within the slit.

13. A kit for assembling a piece of seating furniture, the kit comprising:

a back assembly including a rear beam having a pair of opposing distal ends designed to be received by a pair of side assemblies, the back assembly including a plurality of support beams defining a passage, the back assembly including a covering defining an opening; and a front assembly including a front beam having a pair of opposing distal ends designed to be received by the pair of side assemblies, the front assembly being disposed within the passage and accessible via the opening.

14. The kit of claim 13, wherein the covering includes a slit, and the back assembly includes a frame support secured to one of the support beams and disposed within the slit.

15. The kit of claim 13, wherein the covering includes a front panel having top edge and a bottom edge defining a distance therebetween, and a side panel having a top edge and a bottom edge defining a distance therebetween that is less than the distance between the top edge and the bottom edge of the front panel.

16. The kit of claim 13, wherein the covering includes a back panel having a top edge and a bottom edge defining a distance therebetween, and a side panel having a top edge and a bottom edge defining a distance therebetween that is less than the distance between the top edge and the bottom edge of the back panel.

17. The kit of claim 13, wherein the covering includes a back panel and a front panel collectively defining a cavity, the support beams disposed within the cavity.

18. A kit for assembling a piece of seating furniture, the kit comprising:

a back assembly including a rear beam elongated between a pair of opposing distal ends designed to be received by a pair of side assemblies, the back assembly including a first pair of support beams extending upwardly away from the rear beam at a rear of the back assembly, the back assembly including a second pair support beams extending upwardly away from the rear beam at a front of the back assembly, wherein a passage is defined between the first pair of support beams and the second pair of support beams, the passage elongated between the distal ends; and a front assembly including a front beam having a pair of opposing distal ends designed to be received by the pair of side assemblies, the front assembly disposed within the passage, and the front assembly including a covering disposed around the front beam and within the passage.

19. The kit of claim 18, wherein the front assembly includes a cushion, the covering disposed around the cushion.

20. The kit of claim 18, wherein the covering includes a slit, and the front assembly includes a frame support secured to the front beam and disposed within the slit.

* * * * *